US007278361B2

(12) United States Patent
Zhurong et al.

(10) Patent No.: US 7,278,361 B2
(45) Date of Patent: Oct. 9, 2007

(54) FOLDING TABLE

(75) Inventors: Chen Zhurong, Xiamen (CN); Jin Shenghao, Xiamen (CN); Arvin Patel, Sunnyvale, CA (US)

(73) Assignee: Lifetime Products, Inc., Clearfield, UT (US)

( * ) Notice: Subject to any disclaimer, the term of this patent is extended or adjusted under 35 U.S.C. 154(b) by 438 days.

(21) Appl. No.: 10/669,756

(22) Filed: Sep. 24, 2003

(65) Prior Publication Data

US 2004/0187749 A1 Sep. 30, 2004

(30) Foreign Application Priority Data

Sep. 27, 2002 (CN) ..... 2002 2 59586

(51) Int. Cl.
*A47B 3/00* (2006.01)

(52) U.S. Cl. ..... 108/168; 108/132; 108/169

(58) Field of Classification Search ..... 108/162, 108/171, 172, 166, 167, 168, 169, 174, 125, 108/126, 129, 130, 132, 14, 131; 248/439, 248/169, 188, 188.6, 188.1, 291.1
See application file for complete search history.

(56) References Cited

U.S. PATENT DOCUMENTS

| | | | | |
|---|---|---|---|---|
| 429,458 | A | | 6/1890 | Kraemer |
| 493,441 | A | | 3/1893 | Munz |
| 643,511 | A | | 2/1900 | Lloyd |
| 1,614,187 | A | | 1/1927 | Coggins |
| 1,639,367 | A | | 8/1927 | Seward |
| 1,765,766 | A | | 6/1930 | Lyon |
| 1,907,111 | A | | 5/1933 | Holland et al. |
| 1,976,140 | A | | 10/1934 | Paul |
| 2,542,394 | A | | 2/1951 | Cohen et al. |
| 2,596,250 | A | * | 5/1952 | Klingler ..... 296/20 |
| 2,618,525 | A | * | 11/1952 | Panzer ..... 108/172 |
| 2,619,394 | A | | 11/1952 | Mahr |
| 2,643,926 | A | * | 6/1953 | Pucci ..... 108/131 |
| 2,730,418 | A | | 1/1956 | Blink |
| 2,747,957 | A | | 5/1956 | Lencioni |
| 2,871,076 | A | | 1/1959 | Mell |
| 2,872,259 | A | | 2/1959 | Thorpe |
| 3,143,982 | A | | 8/1964 | Blink et al. |
| 3,368,504 | A | | 2/1968 | Cohen |
| 3,415,208 | A | | 12/1968 | Thoresen et al. |
| 3,656,439 | A | | 4/1972 | Domin |
| 3,731,971 | A | | 5/1973 | Sjogren |
| 3,823,938 | A | | 7/1974 | Unno |
| 3,866,913 | A | | 2/1975 | Zimmers et al. |

(Continued)

*Primary Examiner*—Janet M. Wilkens
(74) *Attorney, Agent, or Firm*—Workman Nydegger

(57) ABSTRACT

A folding table is disclosed having a two-stage folding mechanism. The folding table includes a table top divided into a first planar portion and a second planar portion. A pair of side rails is connected to each planar portion. A foldable leg and support brace is connected to each planar portion. A hinge assembly is provided disposed between the first planar portion and the second planar portion. The hinge assembly includes a hinge pin, a first hinge connector and a second hinge connector. The first hinge connector has a cam portion. A locking pin is disposed through a slot in the second hinge connector. A lock actuating mechanism may be used to move the locking pin in the slot between the locked and unlocked position. In one embodiment, the lock actuating mechanism includes a handle coupled to the locking pin and a spring biased against the locking pin.

28 Claims, 10 Drawing Sheets

U.S. PATENT DOCUMENTS 4,005,898 A 2/1977 Way
4,027,600 A * 6/1977 Mueller ..... 108/169
D247,080 S 1/1978 Robinson
4,089,522 A 5/1978 Rock
4,133,271 A 1/1979 Carlson
4,489,661 A 12/1984 Fitzgerald
4,567,835 A 2/1986 Reese et al.
4,653,804 A 3/1987 Yoo et al.
4,826,244 A * 5/1989 Choi ..... 297/158.4
4,841,877 A 6/1989 Virtue
4,883,314 A 11/1989 Sakong
4,911,085 A 3/1990 Pencoske
4,949,649 A * 8/1990 Terres et al. ..... 108/116
5,009,170 A 4/1991 Spehar
5,154,441 A 10/1992 White et al.
5,357,872 A 10/1994 Wilmore
5,377,601 A 1/1995 Cashen
5,421,272 A 6/1995 Wilmore
5,501,157 A 3/1996 Westerburgen
5,730,066 A 3/1998 Auten et al.
D414,626 S 10/1999 Collins et al.
5,983,807 A 11/1999 Tarnay et al.
6,000,345 A 12/1999 Gillotti
D420,527 S 2/2000 Pinch
6,032,585 A 3/2000 Pinch
6,058,853 A 5/2000 Pinch
6,065,802 A * 5/2000 Bue ..... 297/158.4
6,112,674 A 9/2000 Stanford
6,223,661 B1 * 5/2001 Griepentrog ..... 108/169
6,454,357 B1 9/2002 Foulger
D468,135 S 1/2003 Ashby et al.
D479,778 S 9/2003 Haney et al.
D489,557 S 5/2004 Strong et al.
6,905,166 B2 * 6/2005 Zhurong et al. ..... 297/158.4
2002/0092445 A1 7/2002 Glover et al.
2004/0094076 A1 5/2004 Jin
2004/0187749 A1 9/2004 Zhurong et al.
2005/0005826 A1 * 1/2005 Strong et al. ..... 108/132
2005/0274302 A1 * 12/2005 Jin et al. ..... 108/126

* cited by examiner

FOLDING TABLE

CROSS-REFERENCE TO RELATED APPLICATIONS

This application claims priority to and benefit of Chinese Patent Application No. 02259586.4, filed Sep. 27, 2003, entitled "A Folding Table," which application is incorporated herein by reference in its entirety.

BACKGROUND OF THE INVENTION

1. Field of the Invention

The present invention generally relates to folding tables and, in particular, to a folding table having a collapse and locking system that provides compact folding of the table for better storage, mobility and/or transportability.

2. Description of Related Art

In order to increase the practical utility of existing furniture, whether household furniture or office furniture, there are continually increasing demands on their function. For example, tables are known to support all types of activities such as reading, writing, drawing, crafts, projects, holding objects, storing items, and the like. However, when not in use, a table can become inconvenient, especially in locations where space is limited or needed for other activities. For this reason, conventional folding tables have been developed. By providing a folding mechanism, tables can be collapsed for easier transportation and storage. Advantageously, this allows tables to be stored vertically or horizontally and placed in, for example, a storage closet or against a wall.

Various mechanisms for folding a table have been developed. For example, FIG. 1 shows a conventional folding table that can be used for various indoor and outdoor activities. The folding table includes a table top 10 and a support assembly 12. The support assembly 12 includes a pair of side rails 16, a pair of cross bars 18 positioned at opposing ends of the table, and a pair of legs 20. Additionally, two support braces 22 may be coupled to the table top 10 and legs 20. The two legs 20 are pivotally attached to the table top. When it is desired to store the table, legs 20 are pivoted towards the bottom surface of the table top until the legs are positioned substantially parallel to the bottom surface of the table top 10. Advantageously, this reduces the space required to store the table. Disadvantageously, the conventional folding table shown in FIG. 1 still has a relatively large size because of the large area of the table top.

There are many situations where it would be desirable to have a table of a size comparable to the table shown in FIG. 1. Camping and traveling are some examples. However, transporting the conventional table shown in FIG. 1, even in its folded state, is often difficult and sometimes unreasonable. In particular, a conventional folding table often does not easily fit in the trunk or backseat of a car. Thus, a person may be required to use a larger vehicle or attach a trailer to their vehicle if they desire to transport a conventional folding table.

In addition, many people have a limited amount of space in their home or office where they can store a conventional folding table, even in its folded state. Often, a person must store the table upright against a wall, which may inadvertently fall or move. If the table is stored horizontally, the table takes up space which might be used for other objects.

In addition, a conventional folding table is often difficult and unwieldy for a single person to transport, even in its folded state. In particular, a large folding table can be very difficult for a single person to lift and move by themselves. Further, when the legs of a conventional folding table are in the folded or collapsed position, the legs structures may extend outwardly from the table top and the legs may undesirably catch on or strike other objects.

SUMMARY OF THE INVENTION

A need therefore exists for a folding table that eliminates the above-described disadvantages and problems.

One aspect of the invention is a table that has a large enough table top to provide the area needed for most activities, but which provides a compact structure which is easily lifted and transported. Desirably, the table includes a table top that can be compactly folded so that space can be effectively saved after it has been folded. The folding table, for example, may include a table top, a support assembly that is sized and configured to support the table top in an upright position, and a hinge assembly that is configured to allow the table top to fold.

Advantageously, the folding table may include a generally rectangular table top. The table top, however, may be configured in any suitable size and shape depending, for example, upon the desired use of the table, including, but not limited to, circular, square, oblong, and the like.

Another aspect is a table with a table top that is divided into a first planar portion and a second planar portion. That is, an imaginary transverse plane intersects the table top at a point between the first end and the second end to divide the table top into the first planar portion and second planar portion. Each of the planar portions desirably has an interior edge that faces the other. Each planar portion also has an outer edge extending around the periphery. The interior edges of the planar portions are sized and configured to engage so that the seam formed between the planar portions when the table top is unfolded is preferably as small or minimal as possible. A lip may extend downwardly from the outer edges of the planar portions, if desired. Advantageously, the lip may be configured to attach to portions of the support assembly and also to hide portions of the support assembly.

Yet another aspect is a table with a table top that is selectively moveable between a working position and a storage position. In the working position, the interior edges of each planar portion are positioned so that they interface with each other and are not exposed to the exterior. In the storage position, in contrast, the interior edges of the planar portions do not interface such that they are exposed to the exterior similar to the outer edges.

Still another aspect is a table with a support assembly that includes two pairs of spaced-apart side rails that are connected to the first and second planar portions of the table top. Preferably a leg is coupled to each pair of side rails and a support brace may be coupled to each leg to assist in maintaining each leg in the extended position.

In greater detail, the first planar portion of the table top may include a pair of spaced-apart side rails and the second planar portion of the table top may also has a pair of spaced-apart side rails. Desirably, each side rail has an interior end and an exterior end and the side rails may have one or more apertures formed transversely through the exterior end. The side rails are preferably configured to connect to the legs of the support assembly at the exterior ends. The interior ends of the side rails are preferably disposed in a channel or aperture or other structure for coupling the side rails to the hinge assembly.

Still another aspect is a table in which each leg includes two leg members, a cross bar disposed at the proximal end of the leg members, and a cross bar transversely disposed between and joining the leg members. Desirably, the proximal end of the legs is pivotally coupled to the planar portions. In one embodiment, the crossbars located at the proximal ends of the legs are pivotally coupled to apertures located at the exterior ends of the side rails. As such, the legs are able to be selectively positioned between an extended position and a folded position.

Preferably, a first support brace is connected to the first leg and a second support brace is connected to the second leg. Each brace may include a V-shaped swivel portion, an extension portion and a base portion. Desirably, the base portion is coupled to the hinge assembly and the swivel portion is coupled to the legs. Each swivel portion may include a first swivel arm and a second swivel arm. In addition, a bracing ring may be slidably disposed over the extension portion to rest over the joint of the swivel arms and the extension portion. The swivel portion of the support brace allows that portion of the support brace to fully extend when the leg is fully extended, and to rotate inwardly to fold back onto the extension portion into a compact structure when the leg is folded. As such, the support brace is selectively moveable between an extended position and a folded position simultaneously with the operation of the legs.

Advantageously, the hinge assembly is configured to allow a user to selectively position and maintain the table top between a working position and a storage position. The hinge assembly is preferably disposed between the first planar portion and the second planar portion of the table top. For example, one hinge assembly may be placed at each end of the interface between the first planar position and the second planar portion. Additionally, at least one hinge assembly may have a locking mechanism that allows the table top to be locked in a working position.

Another aspect is a table with a hinge assembly that includes a hinge pin which is disposed under the bottom surface of the table top in a transverse plane dissecting the table top. The longitudinal axis of the hinge pin may form a hinge axis about which the table top folds between the working and the storage positions. The hinge pin, for example, for both of the hinge assemblies on either side of the table top may be the same structure. The hinge assembly may also include a first hinge connector and a second hinge connector. The first hinge connector may include a body and a connector portion. The body is preferably configured to be coupled to a side rail or other structure of the first planar portion of the table top. The connector portion of the first hinge connector may include one or more webs extending from the body and each web desirably has a substantially circular configuration. One or more of the webs may include a hook or cam portion. Along the length of the connector portion is one or more apertures that are preferably sized and configured to receive the end of a structure of a support brace. The one or more webs of the connector portion may include one or more apertures that are sized and configured to receive an end of a hinge pin.

In addition, the second hinge connector may include a body and a connector portion. The body is preferably configured to be coupled to a side rail or other structure of the second planar portion of a table top. The body desirably has substantially the same configuration as the body of the first hinge connector, but the connectors could have any suitable size and configuration. The connector portion of the second hinge connector preferably includes one or more webs extending from the body and each web desirably has a substantially circular configuration. The connector portion of the second hinge connector may have one or more apertures that are sized and configured to receive an end of a structure of a support brace. The connector portion may also include one or more apertures configured to receive an end of the hinge pin. The connector portion of the second hinge connector may also include one or more elongate locking slots configured to receive a locking pin.

Advantageously, the locking pin and locking slots can cooperate with the cam portion of the first hinge connector to form the locking mechanism. In operation, the first hinge connector and second hinge connector may be pivotally disposed about the hinge pin in opposing directions. The locking pin is desirably disposed through the locking slot(s) and the selective positioning of the locking pin within the locking slot(s) dictates the status of the locking mechanism.

In the locked position, the locking pin is displaced in the locking slot(s) closest to the hinge axis. When the locking pin is in the locked position, the cam portion of the first hinge connector abuts against the locking pin. Thus, the first hinge connector is unable to rotate with respect to the hinge axis. This prevents the table top from folding together. In the unlocked position, the locking pin is placed in the locking slot(s) in the position farthest away from the hinge axis. In this position, the cam portion is not impeded by the locking pin such that the first hinge connector can freely rotate about the hinge axis. The table top can rotate such that it may be folded from the working position to a storage position. The table top is only impeded in its rotation by the limit created when the interior edges of the first and second planar portions meet.

Another aspect is the selective positioning of the locking pin between the locked and unlocked position can be performed manually. Alternatively, a lock actuating mechanism is employed. The lock actuating mechanism may include a lever that has a connector portion rotatably disposed about the hinge axis and a handle portion at the opposing end. The lock actuating mechanism may also include an anchoring portion. The lock actuating mechanism includes a displacement slot which is disposed at an offset angle with respect to the locking slot(s) when the lock actuating mechanism is included as part of the hinge assembly.

The displacement slot of the lock actuating mechanism allows movement of the locking pin within the lock actuating mechanism so that the lock actuating mechanism does not interfere with the movement of the locking pin. Alternatively, the displacement slot may actually serve to assist in moving the locking pin within the locking slot(s). That is, the movement of the handle of the lock actuating mechanism displaces the locking pin within the locking slot(s) from the locked position to the unlocked position. This may be due to the offset angles of the displacement slot and the locking slot(s).

The lock actuating mechanism may also include an anchoring portion which is an elongate structure that extends outwardly from the handle. The anchoring portion includes a first groove and a second groove. The grooves are shaped to substantially conform to the outer surface of a structure of a support brace to engage the support brace in the two different groove positions. In the locked position, the second groove engages the support brace. In the unlocked position, the first groove engages the support brace. As such, the lock actuating mechanism is reinforced such that it assists to maintain or anchor the locking pin in the locking slot(s) between the locked and unlocked positions.

Still another aspect is the lock actuating mechanism may include a handle with a first end coupled to the locking pin and a second free end. The lock actuating mechanism may further include a spring that has one end biased against the locking pin and a second end coupled to one of the first or second leg. The cam portion can also include a first or top exposed edge and a second or bottom exposed edge. When the table is in the folded position, the locking pin is biased by the spring in the locked position in which the top exposed edge of the cam portion abuts the locking pin. As the table is unfolded, the top exposed edge of the cam portion presses the locking pin into the unlocked position, against the bias of the spring. As the table top becomes substantially flatter, the top exposed edge of the cam portion no longer is able to engage the locking pin and, instead, the bottom exposed edge of the cam portion engages the locking pin. At the same time, the force against the locking pin is released and the spring biases the locking pin into the locked position. The locking pin is removed from the locked position by pulling the free end of the handle.

Another aspect is a folding table that employs a two-stage folding process to provide an enhanced compact folding structure. That is, the folding table can be collapsed from a fully working structure to a folded, compact structure. In the first stage, a folding table begins in an upright position in which the support assembly maintains the table top in an upright fashion. In this position, the first and second planar portions are substantially aligned with each other to provide a working surface. The table is turned upside down to provide greater access to the support assembly. The legs and support braces are folded from an extended position to a folded position.

In the second stage, the hinge assembly is manually or otherwise unlocked such that the cam portion of the first hinge connector does not contact the locking pin. The first planar portion and second planar portion of the table top are thus able to rotate about the hinge axis to fold the table top. In the second stage, the support assembly also folds in half to be disposed within the halves of the table top. As such, a highly compact structure is provided which provides ease of storage.

Advantageously, the folding table may be stored in storage spaces that are not suitable for conventional folding tables, such as closets, trunks of cars or backseats of cars. In addition, the folding table may provide a more compact structure that is easier for a person to carry and transport. In addition, the folding table allows a table which has the size of a conventional folding table, but is much easier to move and transport. Further, when the folding table is in the folded or collapsed position, the legs or leg structures preferably do not extend outwardly from the table top.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further clarify the above and other aspects, advantages and features of the present invention. It will be appreciated that these drawings depict only preferred embodiments of the invention and are not intended to limits its scope. The invention will be described and explained with additional specificity and detail through the use of the accompanying drawings in which.

DETAILED DESCRIPTION OF THE PREFERRED EMBODIMENTS

I. Introduction

Figure 1:
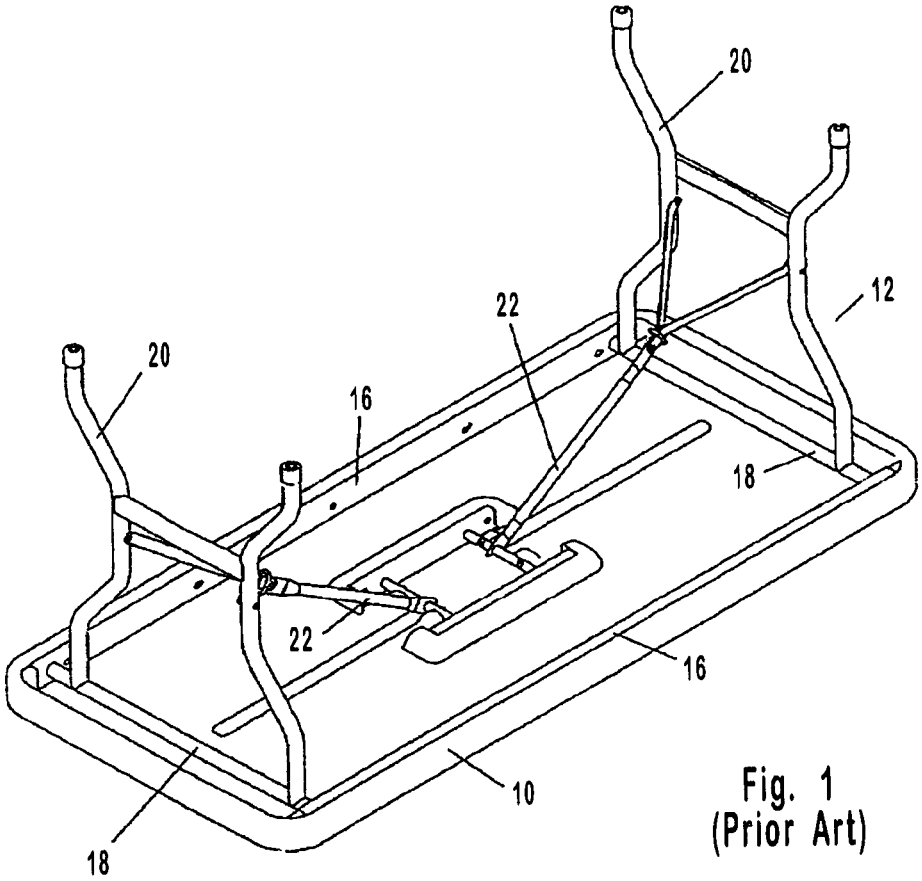
Fig. 1 (Prior Art)
FIG. 1 is a perspective view of a conventional folding table.
Figure 2:
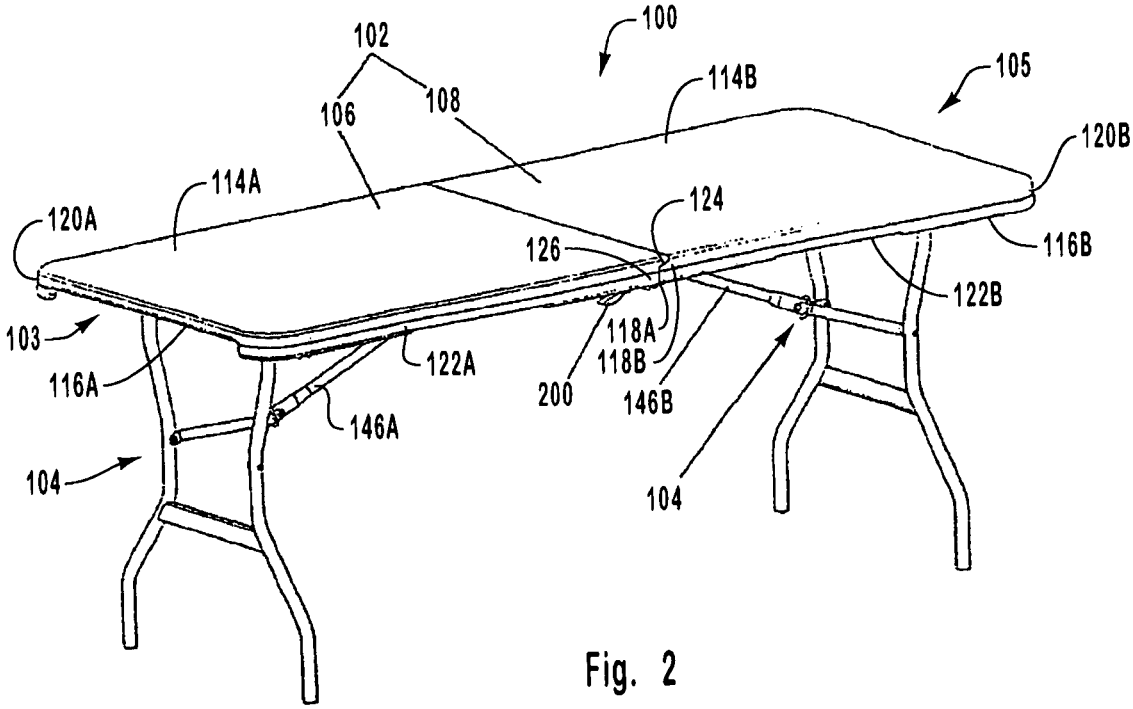
FIG. 2 is a top perspective view of a folding table in accordance with a preferred embodiment of the present invention.

The present invention is directed to folding tables. In particular, the folding tables of the present invention have a two-stage folding mechanism which results in a highly compact structure. With reference to FIG. 2, a table 100 is shown having a table top 102 and a support assembly 104 configured to hold the table top upright. Table 100 is configured to fold into a highly compact structure, shown best in FIG. 5.

Figure 4:
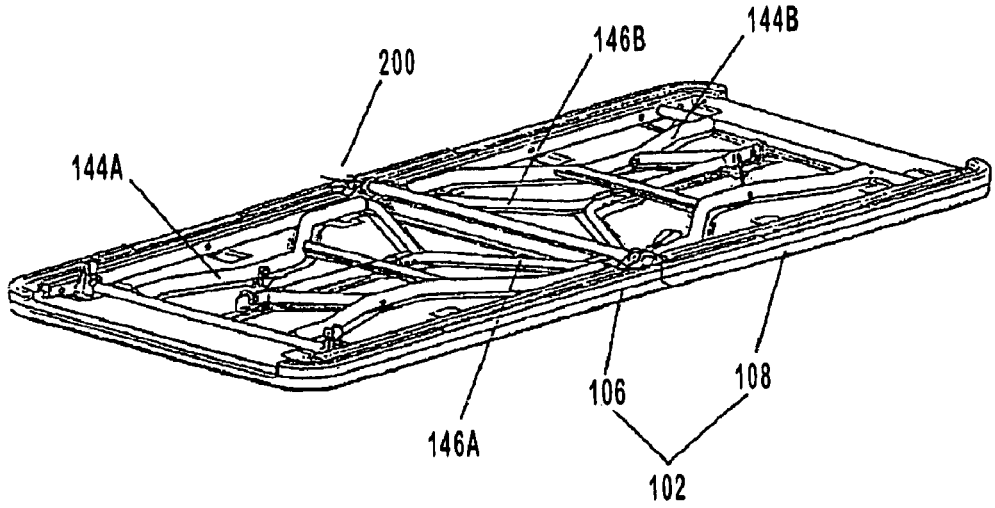
FIG. 4 is a bottom perspective view of the folding table shown in FIG. 2, illustrating the legs in a collapsed or folded position.
Figure 5:
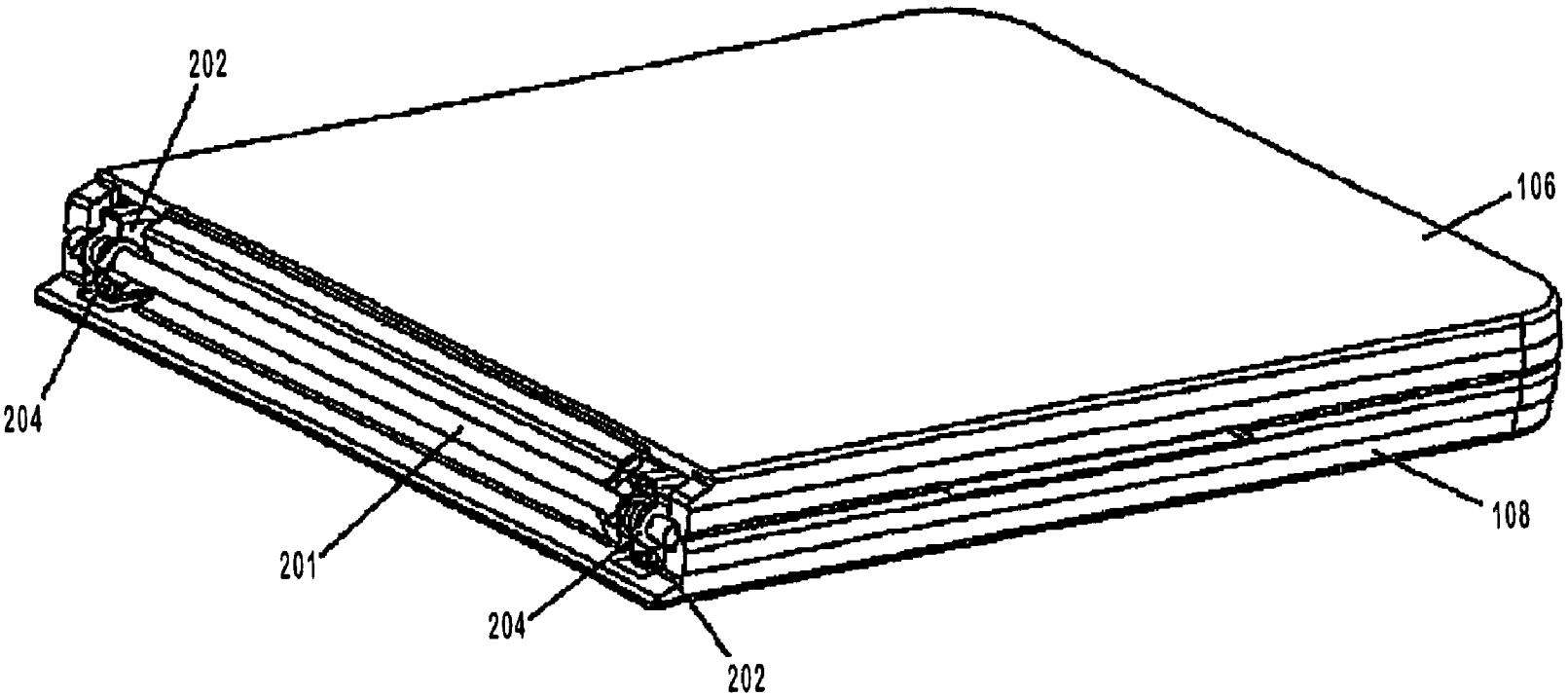
FIG. 5 is a perspective view of the folding table shown in FIG. 2, illustrating the table in a folded or collapsed position.

Generally, to go from the configuration of FIG. 2 to that of FIG. 5, a two-stage folding mechanism is used which provides the enhanced compactness of the folded table of FIG. 5. In the first stage, as will be discussed in further detail below, the support assembly 104 is selectively positionable between an extended position (FIG. 2) and folded position (FIG. 4). In the second stage, after support assembly 104 is folded, table top 102 is selectively positionable between a working position (FIG. 4) and a storage position (FIG. 5). Note that support assembly 104 also undergoes enhanced folding in which the support assembly is folded in half and disposed entirely within the folded portions of the table top. A hinge assembly 200 is provided for allowing table top 102 to be positioned between the working position and storage position and to securely maintain table top 102 in the working position without folding unexpectedly.

As used herein, the terms "extended," "folded," "working" and "storage" are used to refer to specific folding configurations of table 100 and not to particular uses of the table. For example, the term "working" when used to indicate that table top 102 is unfolded does not infer that portions of table top 102 cannot be used when in the "storage" position. In fact, in the "storage" position, table 100 may actually be useful for various purposes such as to provide a hard work surface upon which to write, to provide a surface on which to store other objects, and the like.

Accordingly, the present invention provides for a compact structure that takes up less space than a conventional folding table. In the embodiment of FIG. 5, the table takes up half of the area as the structure of a corresponding conventional folding table that does not have the additional folding utility of the present invention. These and other features of the folding tables of the present invention will now be discussed in detail.

II. Foldable Table Top

Figure 3:
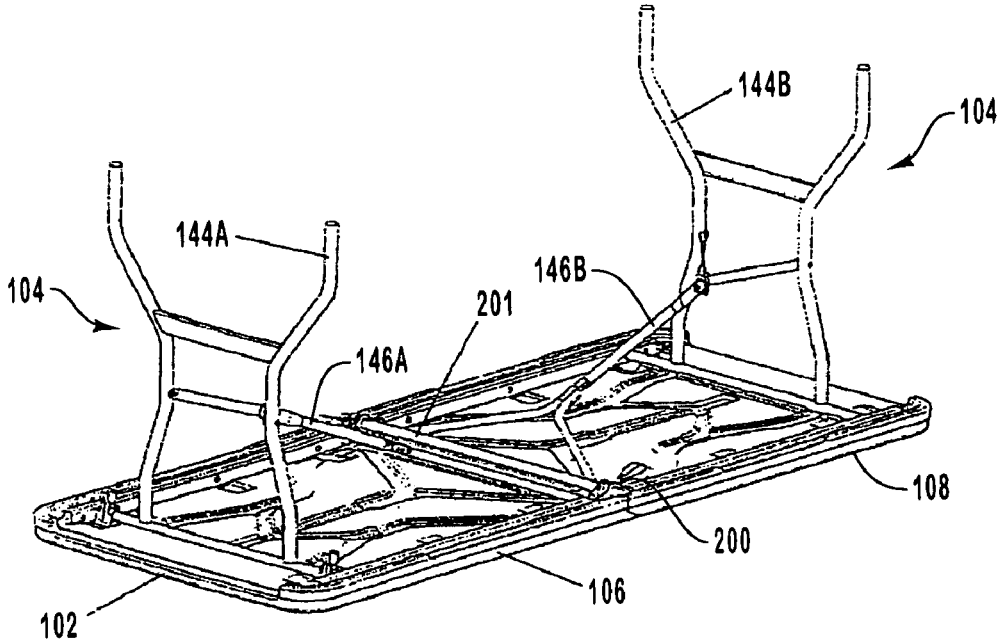
FIG. 3 is a bottom perspective view of the folding table shown in FIG. 2, illustrating the legs in an extended position.

With reference to FIGS. 2 and 3, table 100 includes a rectangular table top 102. Table top 102 may be configured in any shape suitable for the particular uses of table 100 including, but not limited to, circular, square, oblong, and the like. Table top 102 has a first end 103 and a second end 105. Table top 102 further includes a top surface 114 and an opposing bottom surface 116 extending between first end 103 and second end 105. As shown in FIG. 3, bottom surface 116 may have various depressions or grooves to receive portions of support assembly 104.

As shown in FIG. 2, table top 102 is divided into a first planar portion 106 and a second planar portion 108. That is, an imaginary transverse plane (not shown) intersects table top 102 at a point between first end 103 and second end 105 to divide the table top 102 into planar portions 106, 108. In one embodiment, the plane intersects table top 102 at equidistant points from first end 103 and second end 105 so that planar portions 106, 108 have equal areas. However, planar portions 106, 108 can be formed to have different sizes. In addition, table top 102 may be divided into more than two portions to provide an even more compact structure.

In the embodiment of FIG. 2, table top 102 is divided into two equal planar portions 106, 108, with each portion having similar elements, which elements are referred to herein with like reference numerals. The notation "A" is used to indicate those elements which are found on the side of the first planar portion 106 and "B" to refer to those elements located on the side of the second planar portion 108. Thus, each planar portion 106, 108 includes a top surface 114A, 114B and an opposing bottom surface 116A, 116B. Planar portions 106, 108 are configured so that each has an interior edge 118A, 118B, respectively. Planar portions 106, 108 also have an outer edge 120A, 120B extending around the outer periphery thereof which cooperate to form the outer edge of table top 102.

Interior edges 118A, 118B of planar portions 106, 108 are configured to matingly engage so that the seam formed between planar portions 106, 108 when table top 102 is unfolded is as minimal as possible. In one embodiment, interior edges 118A, 118B are flat so that the surfaces thereof matingly engage. In another embodiment, illustrated in FIG. 2, one of the planar portions 106, 108 may have an upper tenon 124 while the other of the portions has a lower tenon 126 such that the upper tenon and lower tenon matingly engage when the table top 102 is unfolded. Other configurations using tenons, mortises, grooves, ridges, and the like may be designed to provide optimal interfacing and engagement between first and second planar portions 106, 108.

Planar portions 106, 108 include lips 122A, 122B extending downwardly from the outer edges 120A, 120B thereof. Portions of support assembly 104 may be attached to downwardly extending lips 122A, 122B. For example, portions of support assembly 104 may be attached to an inner surface of the downwardly extending lips 122A, 122B by one or more fasteners. It will be understood that other suitable means or methods for attaching the support assembly 104 to the table top 102 may be employed, including, but not limited to, rivets, screws, bolts, glues, epoxies, or other bonding materials. The height of the inner surface of the lips 122A, 122B is preferably generally equal to or greater than the height of side rails of the support assembly 104 (discussed below) so that the side rails are generally hidden from view when the table 100 is viewed from a plane generally aligned with the upper surface 114 of table top 102. Advantageously, because portions of support assembly 104 may be completely or generally hidden from view, portions of support assembly 104 do not have to be finished and may contain visible imperfections or flaws. In addition, because portions of support assembly 104 may be completely or generally hidden from view by lips 122A, 122B, a more aesthetically pleasing table 100 may be created. It will be appreciated, however, that lips 122A, 122B do not have to hide portions of support assembly 104.

Table top 102 can be constructed of any material which provides sufficient strength for the purposes for which table 100 is intended. Table top 102 may also be constructed from a lightweight material which allows the table 100 to be easily transported. In one embodiment, table top 102 can be constructed out of plastic such as, but not limited to, blow molded plastic or injection molded plastic. Other suitable materials include, but are not limited to wood and metal.

As discussed above, table top 102 is selectively positionable between a working position (FIG. 4) and a storage position (FIG. 5). In the working position, the interior edges 118A, 118B of planar portions 106, 108 are positioned such that they interface with each other and are not exposed to the exterior. In contrast, in the storage position, the interior edges 118A, 118B of planar portions 106, 108 do not interface, such that they are exposed to the exterior similar to outer edges 120A, 120B. The folding of table top 102 is part of the second stage of the two-stage folding mechanism described above.

III. Foldable Support Assembly

Figure 6:
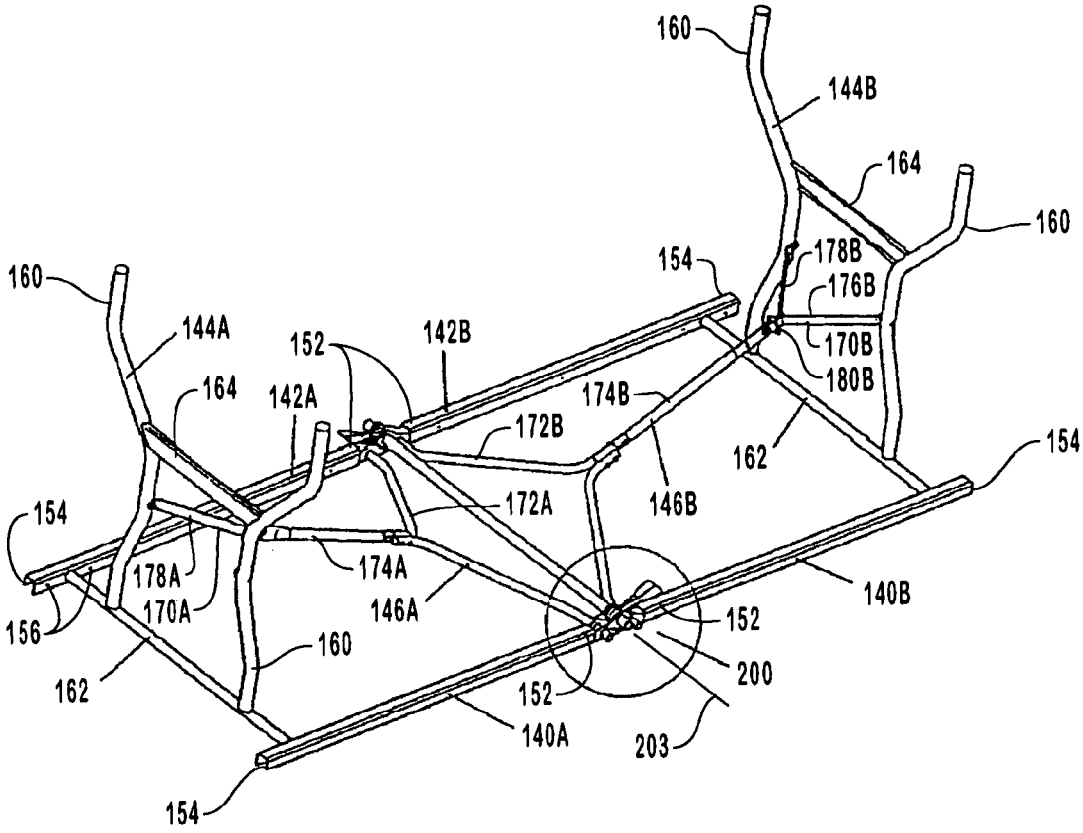
FIG. 6 is a perspective view of a portion of the folding table shown in FIG. 2, illustrating the support assembly and hinge assembly in an extended position.
Figure 7:
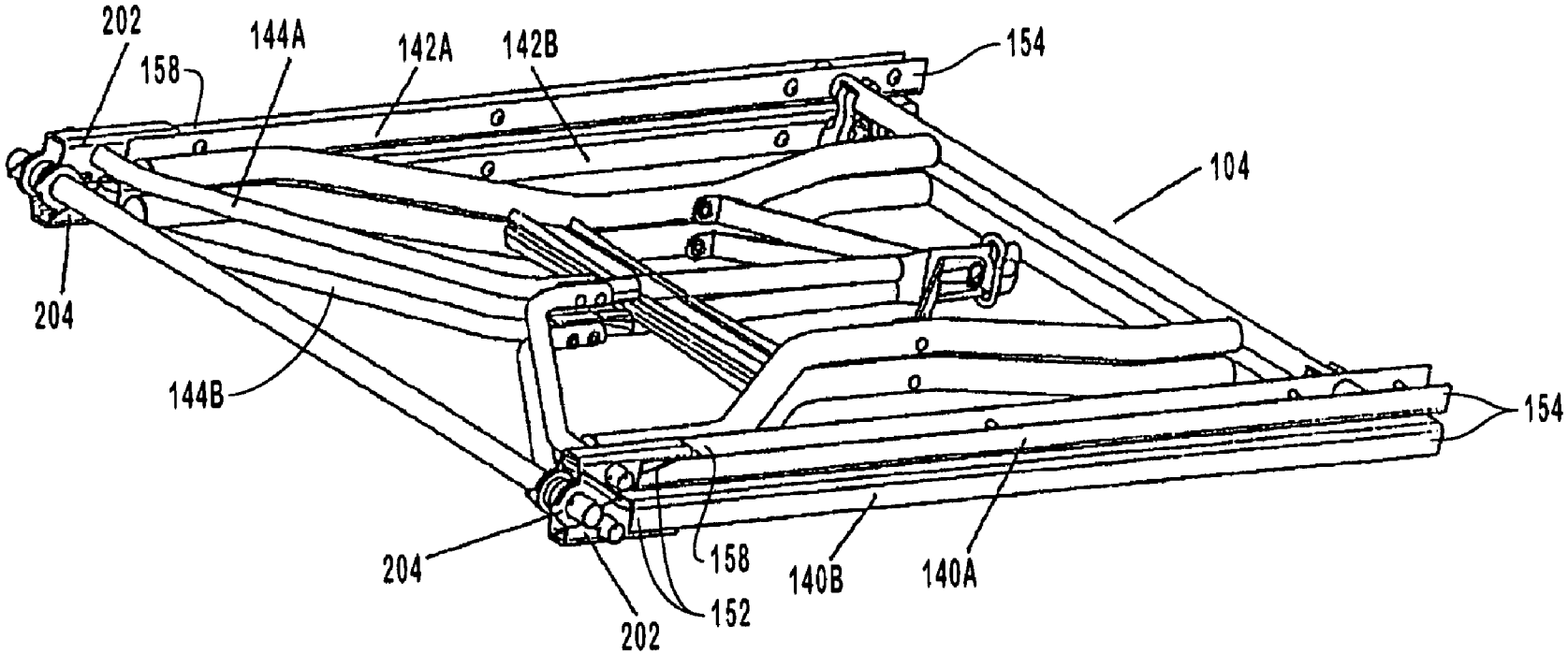
FIG. 7 is a perspective view of a portion of the folding table shown in FIG. 2, illustrating the support assembly and hinge assembly in a folded or collapsed position.

Turning now to FIGS. 3, 6 and 7, support assembly 104 will be described in further detail. Support assembly 104 includes two pairs of spaced apart side rails 140A, 142A and 140B, 142B connected to first and second planar portions 106, 108. Support assembly 104 also includes a pair of legs 144A, 144B coupled to the side rails. A pair of braces 146A, 146B assists to hold legs 144A, 144B upright. As such, legs 144A, 144B are selectively positionable between an extended position (FIG. 3) and a folded position (FIG. 4).

In more detail, first planar portion 106 includes a pair of spaced apart side rails 140A, 142A. Second planar portion 108 has a pair of spaced apart side rails 140B, 142B. Side rails 140, 142 have an interior end 152 and an exterior end 154. Side rails 140, 142 have one or more apertures 156 formed transversely through the exterior end 152 thereof. Side rails 140, 142 are configured to connect to legs 144A, 144B at the exterior ends 154 via apertures 156.

In one embodiment, side rails 140, 142 are preferably hollow members. For example, as shown in FIG. 7, side rails 140, 142 may be elongate U or C-shaped members. Side rails 140, 142 may have any suitable cross-section including, but not limited to, square, circular, ovate, polygonal, and the like. In the embodiment where side rails 140, 142 are hollow, the side rails have an aperture 158 formed at the interior end 152 thereof. In the embodiment where side rails 140, 142 are elongate U or C-shaped members, they have a channel 158 formed at the interior end 152 thereof. Side rails 140, 142 are configured to connect to hinge assembly 200 at the interior end thereof via aperture or channel 158. Alternatively, side rails 140, 142 can be constructed as solid members. Side rails 140, 142 are preferably constructed of a high strength material such as, but not limited to, plastic and metals.

In one embodiment, side rails 140, 142 may be formed integrally with first and second planar portions 106, 108 of table top 102. For example, side rails 140, 142 may be formed integrally with their respective planar portions 106, 108 during an injection molding process. Appropriate apertures or channels may be formed during or after the manufacturing process in order to couple portions of support assembly 104 thereto.

In the embodiment of FIG. 6, each leg 144A, 144B includes two leg members 160, a cross bar 162 disposed at the proximal end of the leg members, and a cross bar 164 transversely extending between and joining the leg members at a point along the length thereof. In FIG. 6, leg members 160 are curved; however, leg members 160 could also be straight. Furthermore, two leg members 160 are not necessary; each leg 144A, 144B may be constructed with a single leg member 160. In embodiments where a single leg member 160 is present, cross bar 164 is not required. The components of legs 144A, 144B are preferably hollow to decrease the weight of support assembly 104 and, ultimately, table 100. In addition, components of legs 144A, 144B are preferably constructed of a high-strength material such as metal or plastic.

First leg 144A is pivotally coupled to first planar portion 106 and second leg 144B is pivotally coupled to second planar portion 108. In the embodiment of FIG. 6, cross bars 162 of legs 144A, 144B are coupled to apertures 156 located at exterior ends 154 of side rails 140, 142. Cross bars 162 of legs 144A, 144B are pivotally connected to side rails 140, 142 while legs 144A, 144B are rigidly connected to cross bars 162 of legs 144A, 144B. Preferably, cross bars 162 have a circular cross-section so that they may be pivotally disposed in apertures 156.

In another embodiment, cross bars 162 could be rigidly connected to side rails 140, 142 while legs 144A, 144B are pivotally connected to cross bars 162. In still another embodiment, legs 144A, 144B might not have cross bars 162 and have only the leg members 160 pivotally coupled to side rails 140, 142. In yet another embodiment, side rails 140, 142 might not be present and legs 144A, 144B might be pivotablly coupled directly to planar portions 106, 108. Importantly, legs 144A, 144B are able to be selectively positioned between an extended position (FIG. 3) and a folded position (FIG. 4).

A first support brace 146A is connected to first leg 144A and a second support brace 146B is connected to second leg 144B. In more detail, first support brace 146A includes a V-shaped swivel portion 170A and a base portion 172A. An extension portion 174A is disposed between swivel portion 170A and base portion 172A. Base portion 172A is a V-shaped member, the ends thereof being coupled to hinge assembly 200. In another embodiment, base portion 172A could be coupled to side rails 140A, 142A. In yet another embodiment, base portion 172A could be coupled directly to first planar portion 106. In still another embodiment, base portion 172A could be eliminated and extension portion 174A elongated and pivotally coupled to side rails 140A, 142A or planar portion 106.

Swivel portion 170A includes a first swivel arm (not shown, but otherwise referred to herein as first swivel arm 176A) and a second swivel arm 178A. Swivel arms 176A, 178A have one end pivotally coupled to extension portion 174A and a second end pivotally coupled to a leg member 160 of leg 144A. A bracing ring 180A may be slidably disposed over extension portion 174A.

As such, support brace 146A is selectively positionable between an extended position (FIG. 3) and a folded position (FIG. 4) simultaneous with the operation of leg 144A. In the extended position, swivel arms 176A, 178A extend outwardly to allow leg 144A to unfold to the fullest extent possible. Bracing ring 180A may be placed over the joint of swivel arms 176A, 178A and extension portion 174A. In the folded position, swivel arms 176A, 178A pivot inwardly, doubling over so that they lie substantially parallel with extension portion 174A. In this manner, support brace 146A is able to compactly fold so that the support brace 146A can be contained within the perimeter of table top 102.

Second support brace 146B is configured substantially similarly to first support brace 146A so corresponding elements are referred to with like reference numbers, substituting "A" for "B" because these elements correspond to planar portion 108. Second support brace 146B is also able to compactly fold in a manner mirroring that of first support brace 146A, as shown in FIG. 4.

The folding of support assembly 104 between an extended position and a storage position is considered as the first stage of the folding mechanism of the present invention. The support assembly 104 is also able to fold as part of the second stage of the folding mechanism. As shown in FIG. 7, in the second stage, the support assembly 104 which has been placed in the storage position is folded in half about the hinge assembly 200. This allows for a compactly folded support assembly 104 which is able to fit within the periphery of the folded portions 106, 108 of table top 102.

IV. Hinge Assembly

Turning now to FIGS. 8–9 and 10–11, hinge assembly 200 will now be discussed in detail. Hinge assembly 200 is configured to allow a user to selectively position and maintain table top 102 between a working position (FIG. 4) and a storage position (FIG. 5). In the working position, planar portions 106, 108 of table top 102 are aligned on the same plane such that planar portions 106, 108 cooperate to form the composite table top 102. In this position, both planar portions 106, 108 are usable as a workable surface. In the folded position, planar portions 106, 108 are arranged such that the bottom surfaces 116A, 116B thereof face each other. In this position, only one of planar portions 106, 108 is potentially usable as a workable surface.

In the embodiment of FIG. 6, two hinge assemblies 200 are implemented, both having a locking mechanism—one hinge assembly is disposed between side rails 140A, 140B and the other between side rails 142A, 142B. This may be preferable to balance the torque forces experienced by the hinge assemblies 200 when folding and unfolding table top 102. However, in another embodiment, two hinge assemblies 200 are used where only one has a locking mechanism. In yet another embodiment, only one hinge assembly 200 is used, that hinge assembly having a locking mechanism. For purposes of discussing the hinge assembly 200, only one hinge assembly will be described with the understanding that the same description and scope applies to other hinge assemblies that may be applied in embodiments of the present invention.

Hinge assembly 200 includes a hinge pin 201. Hinge pin 201 is disposed under bottom surface 116 of table top 102 and in the imaginary transverse plane dissecting table top 102. The longitudinal axis of hinge pin 201 thus forms a hinge axis 203 about which table top 102 folds between the working and storage positions. Hinge pin 201 preferably has a structure and composition which is able to withstand the torque forces experienced by hinge assembly 200 during folding of table top 102. In some embodiment, hinge pin 201 may be a solid, cylindrical member. In other embodiments, hinge pin 201 may be hollow provided that it has sufficient strength to withstand such forces. In some embodiment, lips 122A, 122B include one or more grooves or apertures configured to receive the ends of hinge pin 201 to cover the ends thereof. While hinge pin 201 is shown as a single elongate member, hinge pin 201 may be divided so that a hinge pin 201 corresponds to each hinge assembly 200.

Figure 8:
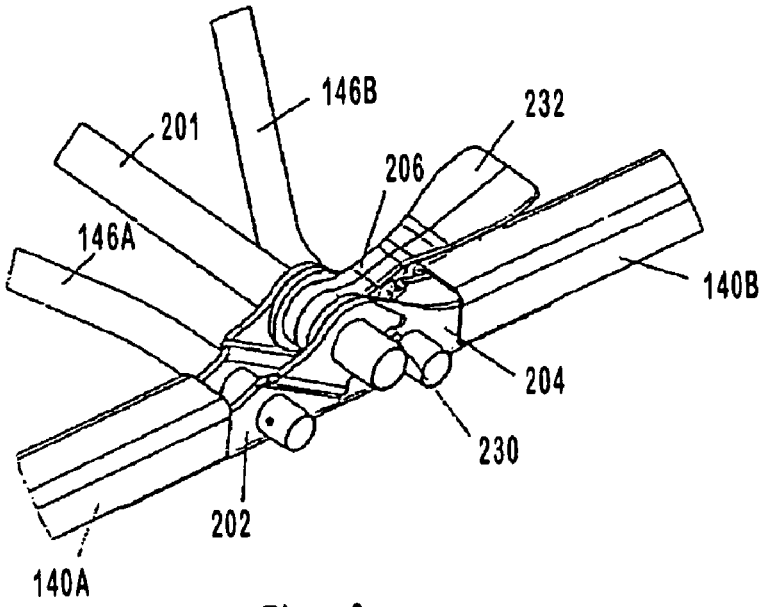
FIG. 8 is a perspective view of a portion of the hinge assembly of the folding table.
Figure 9:
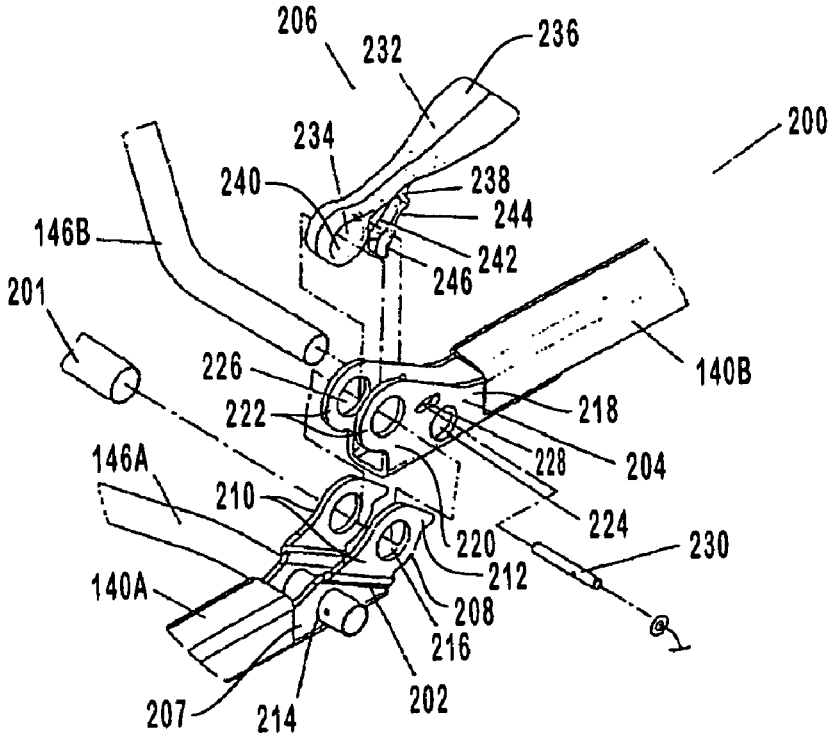
FIG. 9 is an exploded perspective view of the hinge assembly shown in FIG. 8.

As shown in FIGS. 8 and 9, hinge assembly 200 includes a first hinge connector 202, a second hinge connector 204, and a lock actuating mechanism 206. The hinge axis 203 forms the axis of rotation for table 100. Both portions 106, 108 of table top 102 rotate about hinge axis 203. In addition, first and second hinge connectors 202, 204 and lock actuating mechanism 206 rotate about hinge axis 203. Connectors 202, 204 and lock actuating mechanism 206 operate to securely allow table top 102 to be selectively positioned between a working position and a storage position, thus providing enhanced compactness desirable for storage and/or transportation purposes.

First hinge connector 202 includes a body 207 and a connector portion 208. Body 207 is configured to couple with side rail 140A. In the embodiment of FIG. 8, body 207 is a U-shaped or C-shaped member having one end configured to fit within aperture 158 of side rail 140A. Where side rail 140A is also a U or C-shaped member, body 207 fits inside or outside of side rail 140A and can be coupled thereto by means such as welding, soldering, rivets, screws, bolts, glues, epoxies, or other bonding material. Preferably, a tight clearance fit between body 207 and side rail 140A is preferred in order to relieve and transfer some of the torque experienced by hinge assembly 200. In another embodiment where side rails 140A are solid, body 207 of first hinge connector 202 may have another suitable shape configured to attach to side rail 140A by other means such as rivets, screws, bolts, glues, epoxies, or other bonding materials.

Connector portion 208 of first hinge connector 202 includes two parallel wings or webs 210 extending from body 207. Each web 210 has a substantially circular configuration. However, one or both webs 210 also include a hook or cam portion 212 at the end thereof. Along the length of connector portion 208 is a pair of apertures 214 configured to receive an end of support brace 146A. Apertures 214 allow support brace 146A to be pivotally disposed therethrough. In one embodiment, only a single aperture 214 may be provided to allow support brace 146A to be coupled to first hinge connector 202. As discussed above, apertures 214 are not necessary where support brace 146A connects directly to side rails 140, 142 or where the side rails are integrally formed with table top 102 and support brace 146A is configured to directly connect thereto. However, apertures 214 may be provided in first hinge connector 202 where it is more convenient to form connecting structures in the separate structural component provided by first hinge connector 202. In addition, as shown best in FIG. 9, webs 210 of connector portion 208 includes a pair of apertures 216 configured to receive an end of hinge pin 201. Preferably, apertures 214, 216 are circular in cross-section to allow corresponding circular cross-sectioned structures of support brace 146A and hinge pin 201 to pivot therein.

The structure of second hinge connector 204 is similar to that of first hinge connector 202. Second hinge connector 204 includes a body 218 and a connector portion 220. Body 218 is configured to couple with side rail 140B. Body 218 has substantially the same configuration as body 207 of first hinge connector 202. Connector portion 220 of second hinge connector 204 includes two parallel wings or webs 222 extending from body 218. Each web 222 has a substantially circular configuration. However, webs 222 may be configured with a cam portion similar to that of first hinge connector 202 if desired for ease of manufacturing purposes. That way, only one manufacturing mold need be developed.

Connector portion 220 has a pair of apertures 224 configured to receive an end of support brace 146B. As discussed above, apertures 224 are not necessary where support brace 146B connects directly to side rails 140, 142 or where siderails are integrally formed with table top 102 and support brace 146B is configured to directly connect thereto. In addition, connector portion 220 includes a pair of apertures 226 configured to receive an end of hinge pin 201. Preferably, apertures 224, 226 are circular in cross-section to allow corresponding circular cross-sectioned structures of support brace 146B and hinge pin 201 to pivot therein. Furthermore, connector portion includes a pair of elongate locking slots 228 configured to receive a locking pin 230, which will be discussed in more detail below. Locking slots 228 are preferably substantially parallel to table top 102.

Dual webs 210 and 222 on the first hinge connector 202 and second hinge connector 204 are not required in every embodiment. First hinge connector 202 and second hinge connector 204 could be constructed having single webs 210, 222. In the embodiment where first hinge connector 202 and second hinge connector 204 have single webs 210, 222, it will be appreciated that single apertures 214, 216, 224, 226 and locking slot 228 are provided. Desirably, webs 210, 222 are placed having a tight clearance fit on hinge pin 201.

However, dual, symmetrical webs 210, 222 may be a preferred mode when desired to distribute the torque force along hinge pin 201 so that hinge pin 201 does not experience undue force at a single point. In addition, dual webs 222 having dual locking slots 228 provide a more stable pin configuration. Where dual webs 210, 222 are employed, they preferably have a tight clearance fit when assembled on hinge pin 201.

One way of achieving this is to make webs 210 of first hinge connector 202 spaced apart slightly greater than webs 222 of second hinge connector 204. When assembled on hinge pin 201, webs 222 of second hinge connector 204 will nest within webs 210 of first hinge connector 202 such that there is a close interface between first and second hinge connectors 202, 204.

Another way to achieve this is to have webs 210 of first hinge connector and webs 222 of second hinge connector 204 spaced evenly apart but offset by a few millimeters either to the left or right. When assembled on hinge pin 201, both webs 210 will be disposed on the same side of each of webs 222. This embodiment may be advantageous since substantially the same design can be used for both first and second hinge connectors 202, 204. This embodiment would only require an additional locking slot 228 to be stamped or formed in one of the hinge connectors to distinguish it as the second hinge connector.

Hinge assembly 200 further includes a locking pin 230 which is configured to be disposed in locking slots 228 of second hinge connector 204. Because locking slots 228 are elongate, locking pin 230 is able to slide within locking slots 228. Locking pin 230 and locking slots 228 cooperate with cam portion 212 of first hinge connector 202 to form the locking mechanism which will now be described.

Assembly of hinge assembly 200 includes connecting first hinge connector 202 and second hinge connector 204 to side rails 140A and 140B and/or otherwise connecting first and second hinge connectors 202, 204 to structures of first and second planar portions 106, 108. Apertures 216, 226 of first and second hinge connectors 202, 204 are aligned and an end of hinge pin 201 disposed therethrough. Thus, first and second hinge connectors 202, 204 are disposed about hinge pin 201 in opposing directions. Finally, locking pin 230 is disposed through locking slot 228. Structures of support braces 146A, 146B may also be disposed in apertures 214, 224 of first and second hinge connectors 202, 204.

Figure 10:
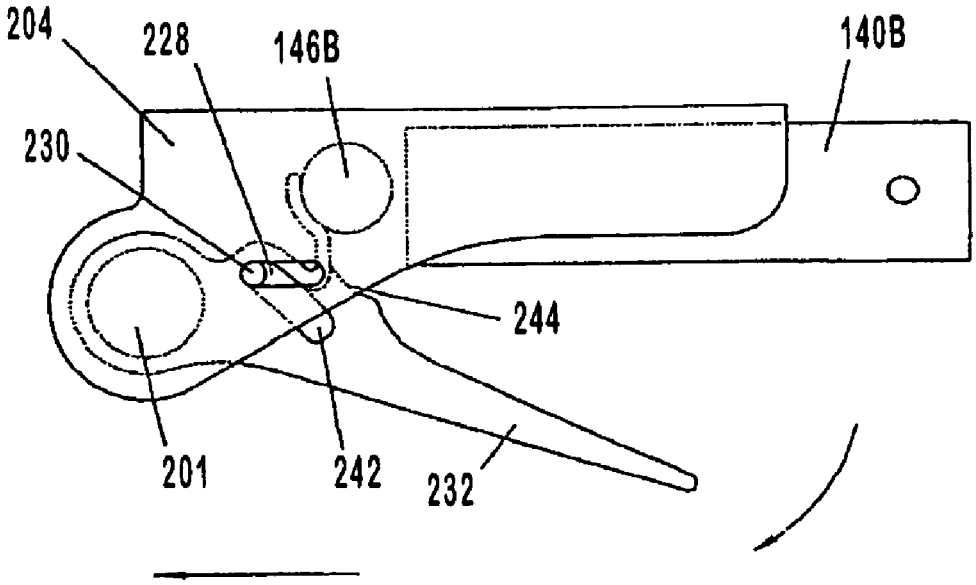
FIG. 10 is a side view of the hinge assembly shown in FIG. 8, illustrating the hinge assembly in a locked position.

In operation, the selective positioning of locking pin 230 within locking slots 228 dictates the status of the locking function, ie., whether the table top 102 is locked or unlocked in the working position. When reference to FIGS. 10 and 11, the positions of locking pin 230 are illustrated. FIG. 10 illustrates the locked position and FIG. 11 shows the unlocked position.

With reference to FIG. 10, in the locked position, locking pin 230 is displaced closest to the hinge axis 203. With the locking pin 230 in the "locked" position, the cam portion 212 of first hinge connector 202 abuts against locking pin 230. Thus, first hinge connector 202 is unable to rotate in the counter clockwise position (using FIG. 10 as a reference point), which prevents table top 102 from folding together. That is, with cam portion 212 abutting against locking pin 230, side rails 140A, 140B are unable to undergo relative rotary motion. Thus, when hinge assembly 200 is in the "locked" position, table top 102 is level and stable. Hinge assembly 200 can be locked before or after legs 144A, 144B are fully unfolded.

Figure 11:
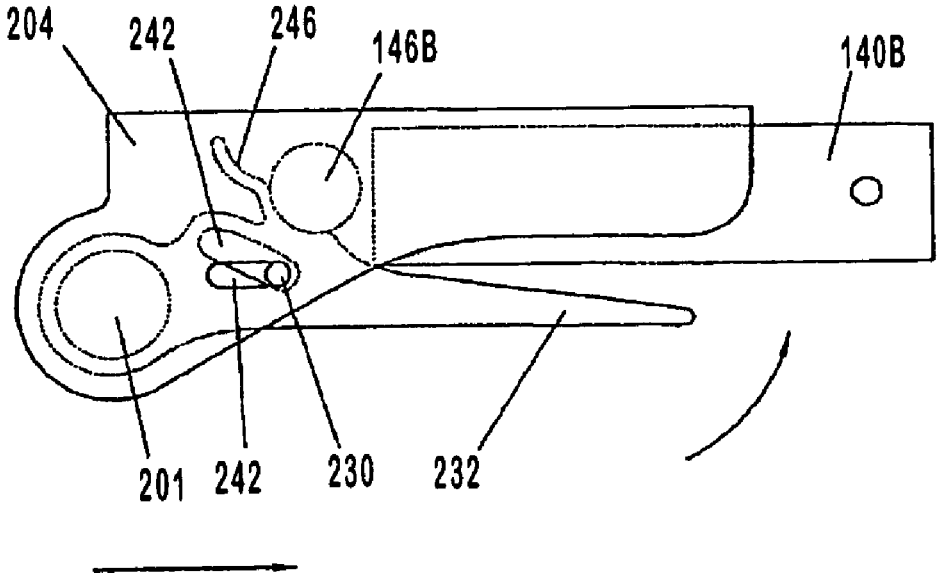
FIG. 11 is a side view of the hinge assembly shown in FIG. 8, illustrating the hinge assembly in an unlocked position.

With reference to FIG. 11, in the unlocked position, locking pin 230 is placed in locking slot 228 in the position farthest away from hinge axis 203. In the unlocked position, cam portion 212 of first hinge connector 202 is not impeded by locking pin 230 such that first hinge connector 202 can freely rotate about hinge axis 203 in both the clockwise and counterclockwise directions. First hinge connector 202 is only impeded by the limit created when the interior edges 118A, 118B of first and second planar portions 106, 108 meet.

In one embodiment, the operation of locking pin 230 can be performed manually. However, because the locking pin 230 is usually small and the space around hinge assembly 200 tight and may present the possibility of pinching fingers, a lock actuating mechanism may be used. An embodiment of lock actuating mechanism 206 is illustrated in FIGS. 6, 8, 9, 10 and 11. Lock actuating mechanism 206 is provided as an additional safety measure and may not be required in some embodiments of the invention.

In one embodiment, lock actuating mechanism 206 comprises a lever 232. As shown in FIG. 9, lever 232 includes at one end a connector portion 234, at the opposing end, a handle portion 236 and an anchoring portion 238 disposed therebetween. Connector portion 234 has an aperture 240 disposed transversely therethrough configured to receive an end of hinge pin 201. Between connector portion 234 and handle portion 236 is an elongate displacement slot 242 corresponding substantially in size and shape to locking slots 228 of second hinge connector 204. When lever 232 is disposed on hinge pin 201 with second hinge pin 204, displacement slot 242 is disposed at an offset angle with respect to locking slot 228 (FIGS. 10 and 11).

The anchoring portion 238 is an elongate structure that extends outwardly from handle portion 236. Anchoring portion 238 includes a first groove 244 and a second groove 246. Grooves 244, 246 are shaped to substantially conform to the outer surface of base portion 172B of support brace 146B.

As shown in FIGS. 10 and 11, and as will be discussed in more detail below, when table top 102 is in a working position, second groove 246 engages base portion 172B of support brace 146B. In contrast, when table top 102 is folded in a storage position, first groove 244 is placed in a position to engage base portion 172B of support brace 146B.

During assembly, lock actuating mechanism 206 may be located within dual webs 210, 222 of first and second hinge connectors 202, 204. In other embodiments where single webs are used, lock actuating mechanism 206 may be placed on either side of the webs so long as locking pin 230 is able to be disposed within locking slots 228 and/or displacement slots 242.

In operation, the lever 232 functions to move locking pin 230 within locking slot 228, which would otherwise have to be done manually. With reference to FIGS. 10 and 11, lever 232 is shown in the locking position and the unlocked position, respectively. Referring to FIG. 10, when locking pin 230 is in the locked position, it is placed nearest hinge axis 203 in both locking slot 228 and displacement slot 242. To move locking pin 230 into the unlocked position, i.e., in the position farthest away from hinge axis 203, handle portion 236 is operated in the counterclockwise position (using FIGS. 10 and 11 as the reference point). The locking pin 230 is forced to slide along locking slot 228 until it reaches the unlocked position. In the unlocked position, locking pin 230 is positioned farthest from hinge axis 203 in both locking slot 228 and displacement slot 242.

In the reverse direction, ie., to go from the unlock to locked position, the handle portion 236 of lever 232 is moved in the clockwise direction. The movement of handle 236 causes locking pin 230 to slide within locking slot 228 to the locked position.

The displacement slot 242 allows the locking pin 230 to move within locking slot 228 without impedance from lever 232. In addition, due to the offset angles of displacement slot 242 and locking slot 228, the displacement slot 242 may actually assist to move the locking pin 230 from one end of locking slot 228 to the other.

In addition, means are provided for anchoring the lock actuating mechanism 206 in the locked and/or unlocked positions. When the hinge assembly 200 is in the unlocked position (FIG. 10), first groove 244 of anchoring portion 238 engages base portion 172B of support brace 146B. When handle portion 236 is operated in the clockwise direction, it forces base portion 172B to be displaced from first groove 244 and transition to engage second groove 246 of anchoring portion 238. The angle of anchoring portion 238 on lever 232 provides enough resistance and force to prevent base portion 172B from being dislodged so that the locking mechanism is maintained in the locked and/or unlocked position. Manual operation of lever 232 is required to provide the force required to disengage base portion 172B from first or second grooves 244, 246.

Hinge assembly 200 may be constructed from any suitable material which provides sufficient strength to the hinge and locking structures. Specifically, first and second hinge connectors 202, 204 are preferably constructed from a high strength metal or plastic. The shapes and apertures required for connectors 202, 204 are easily formed through known manufacturing processes for metals and plastics. Lever 232 is preferably constructed of a high strength metal or plastic through known molding, or injection processes. In particular, anchoring portion 238 of lever 232 is preferably formed from a slightly resilient material which allows anchoring portion 238 to smoothly transition from engaging base portion 172B of support brace 146B in grooves 244 and 246. Depending on the material, the angle of anchoring portion 238 on lever 232 may provide the resilience needed. Locking pin 230 is preferably constructed of a high strength metal or plastic.

V. Two-Stage Folding Mechanism

The operation of the two-stage folding mechanism of table 100 will now be described in detail. FIG. 2 illustrates table 100 of the present invention in a full working position in which table top 102 is in a working position and legs 144A, 144B are in an extended position. Furthermore, in the configuration of FIG. 2, hinge mechanism 200 is preferably in a locked position (FIG. 10) to prevent table top 102 from unexpectedly folding. Preferably, hinging mechanism 200 is maintained in the locked position until table top 102 is ready to be folded to provide the maximum stability when folding legs 144A, 144B.

The first stage of folding involves folding support assembly 104 from an extended position to a folded position. As shown in FIG. 4, when a user is preparing to fold table 100, preferably, the table 100 is turned upside down for easiest access to legs 144A, 144B and hinging mechanism 200. Legs 144A, 144B are positioned from an extended position shown in FIG. 3 to a folded position shown in FIG. 4. This may involve sliding brace rings 180A, 180B along extension portion 174A, 174B of support braces 146A, 146B. Legs 144A, 144B and support braces 146A, 146B fold simultaneously to the folded position shown in FIG. 4.

The second stage of the folding mechanism involves folding table top 102 from a working position to a storage position. The second stage also involves simultaneously folding support assembly 104 so that it compactly fits within table top 102. In the second stage, hinge assembly 200 is placed in the unlocked position (FIG. 11) to allow table top 102 to fold. This may be done manually or using lock actuating mechanism 208 (e.g., lever 232) as described above. In the unlocked position, first hinge connector 202 is able to freely rotate about hinge axis 203, allowing the user to fold first planar portion 106 and second planar portion 108 to the position shown in FIG. 11. This is referred to as the storage position.

As shown in FIG. 11, table 100 has enhanced folding capabilities which decrease the amount of space required for storage. In addition, the compact nature of the storage position in FIG. 5 provides a less wieldy structure which can fit in storage spaces that would otherwise not be useful for conventional folding tables. Such storage spaces include closets, trunks of cars, back seats of cars, and the like. Folding table 100 may be ideal for activities such as camping or traveling which would otherwise not have been possible the conventional folding tables. Furthermore, the compact nature of folded table 100 provides a less wieldy structure than in conventional folding tables. Thus, a single person can easily lift and transport the folded structure shown in FIG. 11.

Advantageously, when the table 100 is folded in its most compact position, hinge pin 203 is exposed so as to provide a handle for carrying the folded table. This increases the transportability of the folding tables of the present invention. Other handle mechanisms may be provided.

Another advantage of the compact folding mechanism of table 100 is that the structures of support assembly 104 are kept entirely within the periphery of portions 106, 108 of table top 102. In this manner, the structures of support assembly 104 are shielded by table top 102 so that they do not present any possibility of catching on other objects or passersby.

To reverse the process, i.e., to unfold table 100 from its compact storage state shown in FIG. 11, first and second planar portions 106, 108 are rotated about hinge axis 203 until the first and second planar portions 106, 108 are on substantially the same plane. Preferably, interior edges 118A, 118B of first and second planar portion 106, 108 provide a limit of rotation. During unfolding of table top 102, hinge assembly 200 is in the unlocked position (FIG. 11). In this position, connector portion 208 of first hinge connector 202 is able to freely rotate about hinge axis 203 in both the clockwise and counterclockwise directions. Locking pin 230 may be manually positioned to the lock position (FIG. 10) which prevents first hinge connector 202 from freely rotating. Alternatively, lever 232 may be operated to displace locking pin 230 to the locked position. With locking pin 230 in the "lock" position, the cam portion 212 of first hinge connector 202 abuts against locking pin 230. Thus, first hinge connector 202 is unable to rotate in the clockwise position, which prevents table top 102 from folding together unexpectedly. In addition, as lever 232 is rotated, engagement of base portion 172B of support brace 146B by first groove 244 is transferred to second groove 246 of anchoring portion 138. Hinge assembly 200 can be locked before or after legs 144A, 144B are fully unfolded, but preferably before legs 144A, 144B are unfolded.

Leg 144A, 144B and support braces 146A, 146B can be unfolded to the extended position as shown in FIG. 3. Bracing rings 180A, 180B may be placed over the intersection of extension portion 174A, 174B and swivel portion 170A, 170B of support braces 146A, 146B to keep the support braces from collapsing. Table 100 is turned right side up to the position shown in FIG. 2.

VI. Alternative Embodiment for Locking Mechanism

Figure 12:
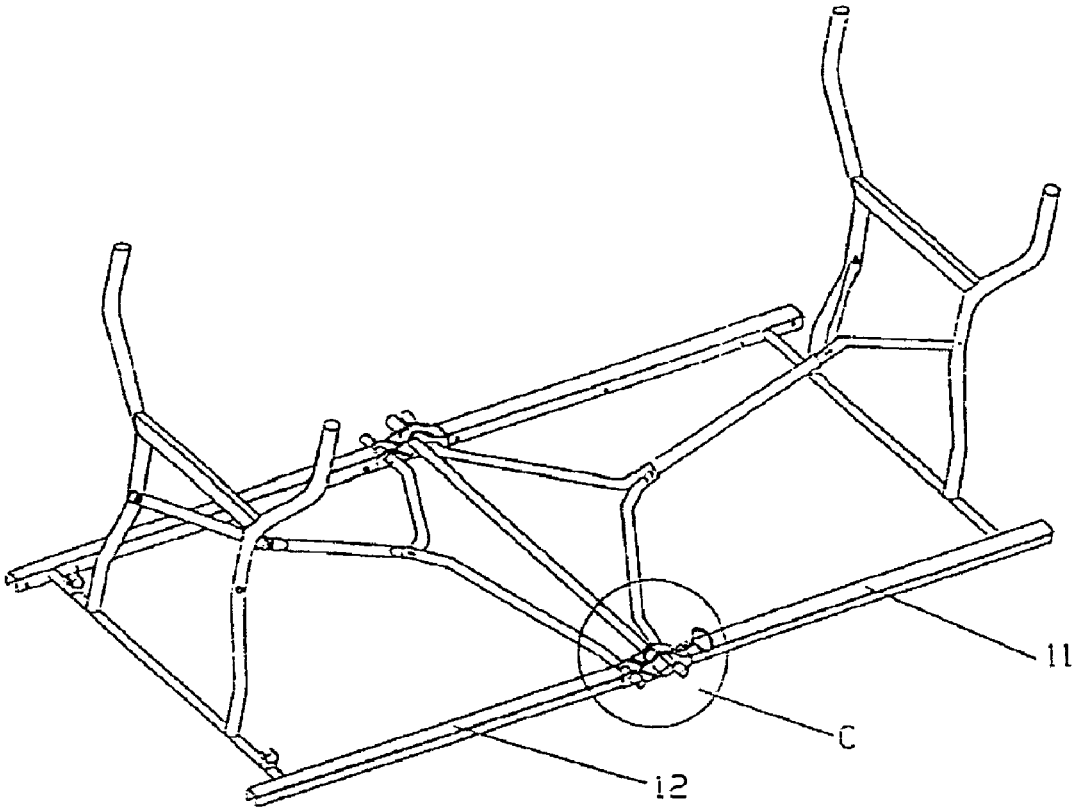
FIG. 12 is a perspective view of the support assembly and hinge assembly of another preferred embodiment of a folding table.
Figure 13:
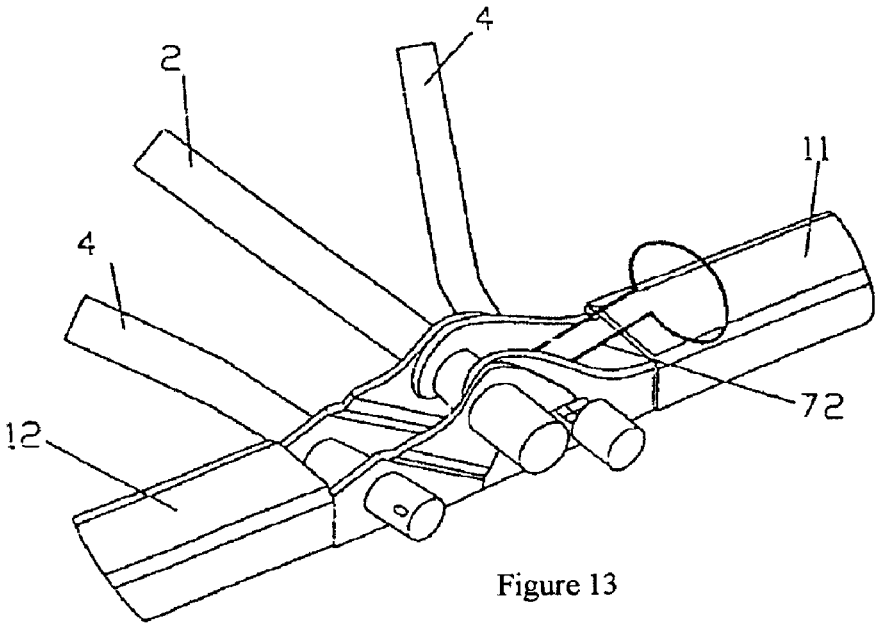
FIG. 13 is an enlarged perspective view of a portion of the support assembly and hinge assembly shown in FIG. 12, illustrating the hinge assembly.
Figure 14:
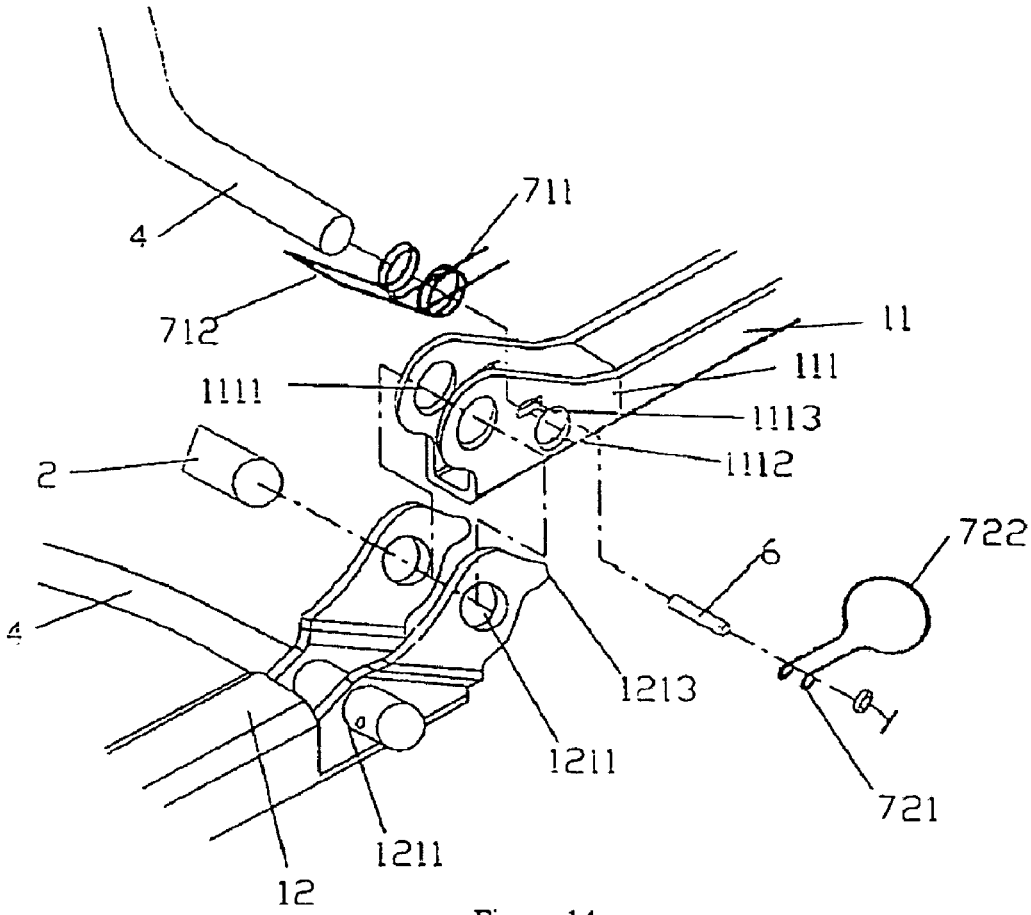
FIG. 14 is an exploded view of the hinge assembly shown in FIG. 13.
Figure 15:
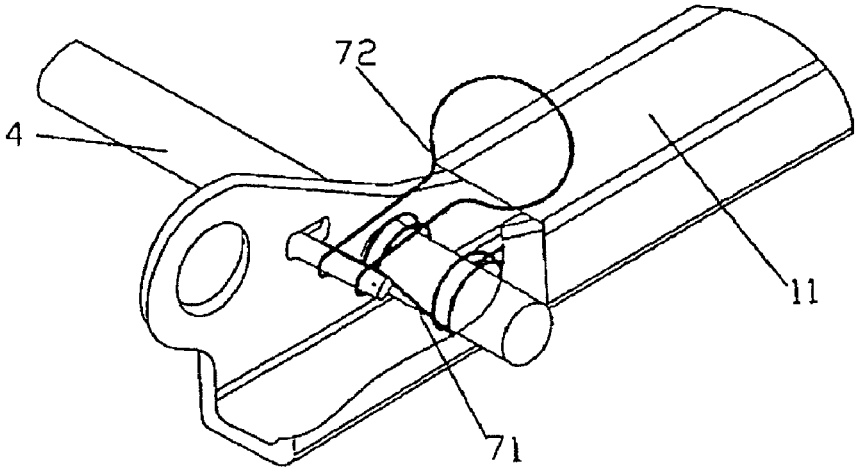
FIG. 15 is a partial perspective view of the hinge assembly shown in FIG. 13.
Figure 16:
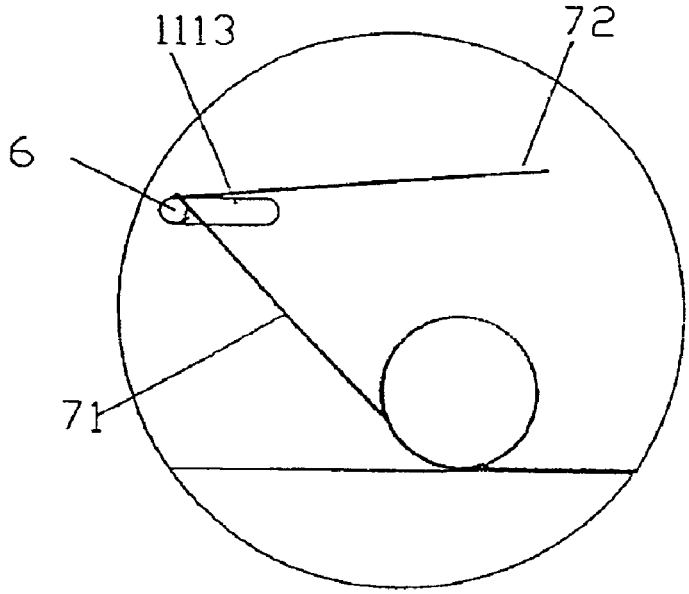
FIG. 16 is a schematic diagram of the hinge assembly shown in FIG. 13.
Figure 17:
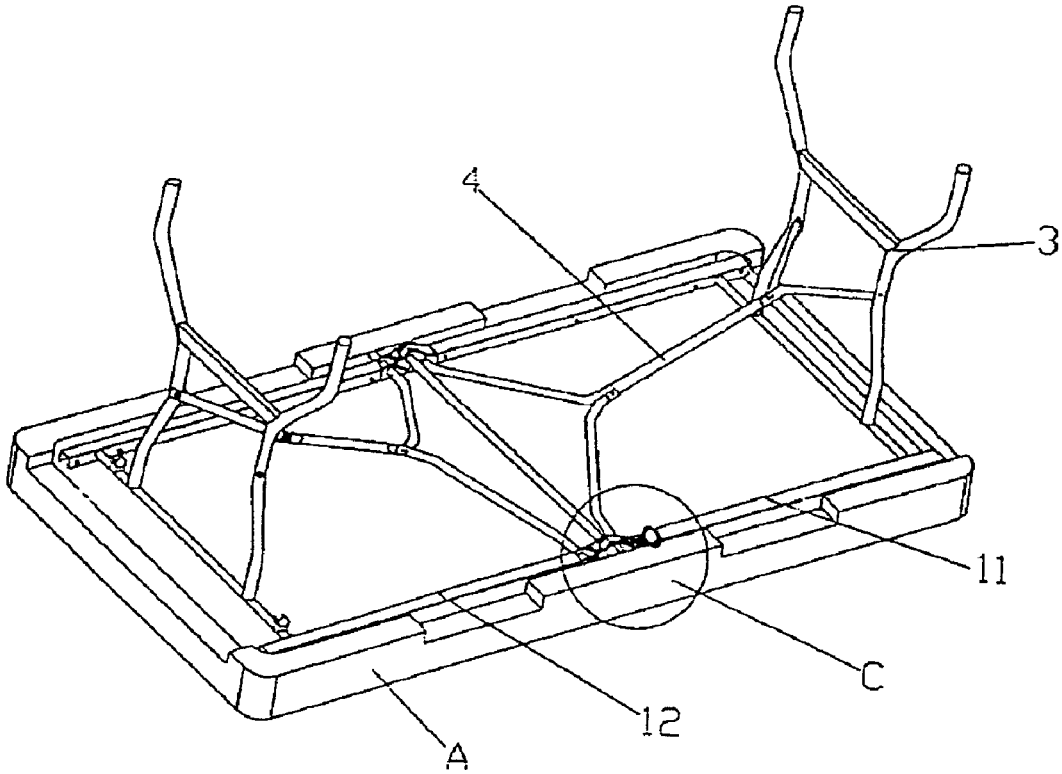
FIG. 17 is a perspective view of the folding table shown in FIG. 12.

With reference to FIGS. 12 through 17, another embodiment of the hinge assembly C is shown. As shown in FIGS. 12, 13 and 17, a table is shown having a table top connected to a support assembly having two pairs of legs 3, two braces 4, and side rails 12, 11. As shown in FIG. 14, hinge assembly C includes a hinge pin 2, first hinge connector 121, and second hinge connector 111. First hinge connector 121 includes an aperture 1211 and second hinge connector 111 includes an aperture 1111 for receiving hinge pin 2. First hinge connector 121 includes another aperture 1211 and second hinge connector includes another aperture 1112 for receiving braces 4, respectively.

First hinge connector 121 includes a cam portion 1213 at one end. The cam portion 1213 has a hook-like structure having a top edge and a bottom edge. In addition, second hinge connector 111 includes a locking slot 1113 which is configured to receive a locking pin 6.

With further reference to FIG. 14, the lock actuating mechanism includes a reset spring 71 and a handle 72. Handle 72 has a first end 721 and a second end 722. First end 721 of the handle 72 is configured to couple with locking pin 6, allowing locking pin 6 to be disposed through locking slot 1113. Second end 722 of the handle 72 is free. Reset spring 71 has a first end 711 and a second end 712. First end 711 of reset spring 71 is coupled to brace 4 while second end 712 rests against locking pin 6.

When unfolding the table, the two planar portions are unfolded from the folded state (FIG. 5) to the unfolded state (FIG. 4). In the process of opening up the two planar portions, the side rails 11, 12 also become unfolded because they are connected to the planar portion. In the process of rotating the side rails 11, 12 in relation to each other, the cam portion 1213 on the first hinge connector 121 connected to side rail 12 also undergoes rotary movement.

The natural tendency of reset spring 71 is to bias the locking pin 6 toward the locked position. As the cam portion 1213 undergoes rotary movement, the top edge of cam portion 1213 applies pressure against locking pin 6, causing the locking pin 6 to move in locking slot 1113 from the locked to the unlocked position (hence against the bias of the spring). When the relative rotary movement of side rails 11, 12 almost or substantially forms a straight line, the top edge of cam portion 1213 becomes disengaged from locking pin 6 and the bottom edge of cam portion 1213 is able to engage locking pin 6. Because the locking 6 is no longer forced toward the unlocked position by the cam portion 1213, the locking pin 6 is reset under the bias of the reset spring 71 to move into the locked position. Thus, locking pin 6 is in a position to limit the movement of cam portion 1213, as discussed above, so that there is no way that side rails 11, 12 can undergo relative rotary movement and a tightly locked state is entered. This causes the unfolded table top to be in a stable state (as shown in FIG. 17).

When it is desired to fold the table, to place the locking pin 6 in the unlocked position, the free end 722 of the handle 72 is pulled, causing the locking pin 6 to move in the locking slot 1113 toward the unlocked position. This also moves locking pin 6 against the bias of the reset spring 71. Locking pin 6 is thus moved to a position in which it becomes disengaged from cam portion 1213, thereby eliminating the locked state in which the side rails 11, 12 were formerly positioned. Side rails 11, 12 are thus able to undergo relative rotary movement and to be folded. After the bottom surface of cam portion 1113 no longer is able to engage locking pin 6, the handle 72 can be released so that locking pin 6 is biased by reset spring 71 to engage the top surface of cam portion 1113. Alternatively, the handle 72 can be pulled until the table top is substantially folded. At this time, folding the two planar portion of the table top can be achieved through the relative rotary movement of the side rails 11, 12 causing the table to go into a completely folded state.

Although this invention has been described in terms of certain preferred embodiments, other embodiments apparent to those of ordinary skill in the art are also within the scope of this invention. Accordingly, the scope of the invention is intended to be defined only by the claims which follow.

The invention claimed is:

1. A folding table comprising:

a table top including a first end and a second end, the table top comprising:

a first section including an upper portion and a lower portion; and a second section including an upper portion and a lower portion, the table top configured to be selectively positionable between a working position in which the upper portion of the first section is generally aligned with the upper portion of the second section and a storage position in which the first section and the second section are folded together;

a first leg pivotally connected to the first section of the table top;

a second leg pivotally connected to the second section of the table top a first hinge assembly connected to the first section of the table top and the second section of the table top, the first hinge assembly comprising:

a hinge pin;

a first hinge connector including a first portion connected to the first section of the table top and a second portion pivotally connected to the hinge pin, the second portion of the first hinge connector including a cam portion;

a second hinge connecter including a first portion connected to the second section of the table top and a second portion pivotally connected to the hinge pin, the second hinge connector including a locking slot;

a locking pin disposed in the locking slot of the second hinge connector, the locking pin movable between a locked position in which the locking pin engages the cam portion of the first hinge connector to lock the table top in the working position and an unlocked position in which the locking pin does not engage the cam portion of the first hinge connector and the table top can be moved between the working position and the storage position;

a handle connected to the locking pin, the handle being sized and configured to move the locking pin between the locked position and the unlocked position; and a spring that is sized and configured to bias the locking pin into the locked position.

2. The folding table as recited in claim 1, wherein the spring is coupled to one of the first leg or second leg.

3. The folding table as recited in claim 1, wherein the cam portion further comprises a first exposed outer edge portion and a second exposed outer edge portion, wherein the locking pin engages the second exposed outer edge portion when the locking pin is in the locked position, and wherein when the locking pin engages the first outer edge portion when the locking pin is in the unlocked position.

4. The folding table as recited in claim 1, further comprising a second hinge assembly connected to the first section of the table top and the second section of the table top.

5. The folding table as recited in claim 4, wherein the second hinge assembly further comprises:

a hinge pin;

a first hinge connector including a first portion connected to the first section of the table top and a second portion pivotally connected to the hinge pin, the second portion of the first hinge connector including a cam portion;

a second hinge connecter including a first portion connected to the second section of the table top and a second portion pivotally connected to the hinge pin, the second hinge connector including a locking slot;

a locking pin disposed in the locking slot of the second hinge connector, the locking pin movable between a locked position in which the locking pin engages the cam portion of the first hinge connector to lock the table top in the working position and an unlocked position in which the locking pin does not engage the cam portion of the first hinge connector and the table top can be moved between the working position and the storage position;

a handle connected to the locking pin, the handle being sized and configured to move the locking pin between the locked position and the unlocked position; and a spring that is sized and configured to bias the locking pin into the locked position;

wherein the hinge pin for the first hinge assembly and the second hinge assembly is the same structure.

6. The folding table as recited in claim 1, further comprising a first side rail and a second side rail which are spaced apart and connected to the lower portion of the first section of the table top, and a third side rail and a fourth side rail which are spaced apart and connected to the lower portion of the second section of the table top, wherein the first hinge assembly is connected to the first side rail of the first section of the table top and the second hinge assembly is connected to the third side rail of the second section of the table top.

7. The folding table as recited in claim 6, wherein the first, second, third and fourth side rails are separate members rigidly attached to the first and second sections of the table top.

8. The folding table as recited in claim 6, wherein the first leg is pivotally connected to the first and second side rails and the second leg is pivotally connected to the third and fourth side rails.

9. A folding table comprising:

a table top including an upper portion, a lower portion, a first end and a second end, the table top including a first section and a second section that are movable between a working position and a storage position;

a first leg pivotally connected to the first section of the table top;

a second leg pivotally connected to the second section of the table top;

a hinge pin disposed underneath the upper portion of the table top, the hinge pin being disposed along an axis;

a first hinge connector including a first portion connected to the first section of the table top and a second portion pivotally connected to the hinge pin;

a second hinge connecter including a first portion connected to the second section of the table top and a second portion pivotally connected to the hinge pin; and a locking mechanism that is sized and configured to selectively lock the table top in the working position, the locking mechanism comprising:

a cam portion on the second portion of the first hinge connector;

a locking slot in the second hinge connector;

a locking pin disposed in the locking slot, the locking pin movable between a locked position in which the table top is locked in the working position and a unlocked position in which the table top is not locked in the working position;

a spring that is sized and configured to bias the locking pin into the locked position; and a handle that is connected to the locking pin, the handle being sized and configured to move the locking pin between the locked position and the unlocked position.

10. The folding table as recited in claim 9, wherein the locking pin abuts the cam portion so as to substantially prevent relative movement of the first hinge connector and second hinge connector when the locking pin is in the locked position to lock the table top in the working position; and wherein when the locking pin is in the unlocked position the first hinge connector and second hinge connector can freely rotate about the hinge pin.

11. The folding table as recited in claim 9, wherein the spring is coupled to the first leg or second leg.

12. The folding table as recited in claim 9, wherein the cam portion further comprises a first exposed outer edge portion and a second exposed outer edge portion, wherein the second exposed outer edge portion engages the locking pin when the locking pin is in the locked position, and wherein the first exposed outer edge portion engages the locking pin when the locking pin is in the unlocked position.

13. The folding table as recited in claim 9, further comprising a first side rail and a second side rail that are spaced apart and connected to the lower portion of the first section of the table top, and a third side rail and a fourth side rail that are spaced apart and connected to the lower portion of the second section of the table top, wherein the first hinge connector is connected to the first side rail of the first section of the table top and the second hinge connector is connected to the third side rail of the second section of the table top.

14. The folding table as recited in claim 13, wherein the first, second, third and fourth side rails are separate members rigidly attached to the first and second sections of the table top.

15. The folding table as recited in claim 13, wherein the first leg is pivotally connected to the first and second side rails and the second leg is pivotally connected to the third and fourth side rails.

16. A folding table comprising:

a table top including an upper portion, a lower portion, a first end and a second end, the table top including a first section and a second section that are movable between a working position and a storage position;

a first leg pivotally connected to the first section of the table top;

a second leg pivotally connected to the second section of the table top;

a hinge pin disposed underneath the upper portion of the table top, the hinge pin being disposed along an axis;

a first hinge connector including a first portion connected to the first section of the table top and a second portion pivotally connected to the hinge pin;

a second hinge connecter including a first portion connected to the second section of the table top and a second portion pivotally connected to the hinge pin;

a first support brace having a first end coupled to the first leg and a second end coupled to the first hinge connector;

a second support brace having a first end coupled to the second leg and a second end coupled to the second hinge connector;

a locking mechanism configured to selectively lock the table top in the working position, the locking mechanism comprising:

a cam portion disposed on the second portion end of the first hinge connector;

a locking slot in the second hinge connector;

a locking pin disposed in the locking slot, the locking pin movable between a locked position in which the table top is locked in the working position and a unlocked position in which the table top is not locked in the working position;

a spring that is sized and configured to bias the locking pin into the locked position; and a handle that is connected to the locking pin, the handle being sized and configured to move the locking pin between the locked position and the unlocked position.

17. A folding table that is movable between a working position and a storage position, the folding table comprising:

a table top including a first section and a second section;

a first support assembly connected to the first section of the table top, the first support assembly being sized and configured to support the first section of the table top above a surface;

a second support assembly connected to the second section of the table top, the second support assembly being sized and configured to support the second section of the table top above a surface; and a hinge assembly connected to the first section and the second section of the table top, the hinge assembly being sized and configured to allow the first section and the second section of the table top to be moved between the working position and the storage position, the hinge assembly comprising:

a first hinge connector including a first portion connected to the first section of the table top and a second portion including an aperture;

a second hinge connector including a first portion connected to the second section of the table top and a second portion including an aperture;

a hinge pin disposed through the aperture in the second portion of the first hinge connector and through the aperture in the second portion of the second hinge connector to connect the first hinge connector and the second hinge connector;

a locking member disposed within an opening in the second hinge connector, the locking member being movable between a locked position and an unlocked position;

a cam portion of the first hinge connector that is sized and configured to engage the locking member when the locking member is in the locked position to maintain the table in the working position; and a biasing member that is sized and configured to bias the locking member into the locked position;

wherein when a force is applied to the locking member that is sufficient to overcome the biasing member, then the locking member may be moved from the locked position to the unlocked position to allow the table to be moved between the working position and the storage position.

18. The folding table as in claim 17, further comprising a frame connected to the table top, the frame including a first portion connected to the first section of the table top and a second portion connected to the second section of the table top, the first hinge connector being connected to the first section of the frame and the second hinge connector being connected to the second hinge portion of the frame.

19. The folding table as in claim 17, further comprising a first support brace including a first end connected to the hinge assembly and a second end connected to the first support assembly; and further comprising a second support brace including a first end connected to the hinge assembly and a second end connected to the second support assembly.

20. The folding table as in claim 17, further comprising a handle coupled to the locking member, the handle being sized and configured to move the locking member between the locked position and the unlocked position.

21. A folding table that is movable between a working position and a storage position, the folding table comprising:

a table top including a first section and a second section;

a hinge assembly including a first portion connected to the first section of the table top and a second portion connected to the second section of the table top, the hinge assembly being sized and configured to allow the first section and the second section of the table top to be moved between the working position and the storage position;

a hinge pin connecting the first portion of the hinge assembly and the second portion of the hinge assembly;

a locking member connected to the second portion of the hinge assembly, the locking member being selectively movable between a locked position in which the locking member engages the first portion of the hinge assembly and locks the hinge assembly in a first position and an unlocked position in which the first portion of the hinge assembly can rotate relative to the second portion of the hinge assembly and the hinge assembly is unlocked; and a biasing member that is sized and configured to bias the locking member toward the locked position.

22. The folding table as in claim 21, wherein the first portion of the hinge assembly includes an outwardly extending flange with an engaging portion, the engaging portion being sized and configured to engage the locking member when the locking member is in the locked position.

23. A folding table that is capable of being folded between a first position and a second position, the table comprising:

a table top including a first section and a second section;

a first support assembly connected to the first section of the table top;

a second support assembly connected to the second section of the table top;

a first hinge assembly connecting the first section of the table top and the second section of the table top, the first hinge assembly being sized and configured to allow the table to be moved between the first position and the second position, the first hinge assembly including a locked position and an unlocked position, the first hinge assembly comprising:

a first hinge portion connected to the first section of the table top;

a second hinge portion connected to the second section of the table top;

a hinge pin connecting the first hinge portion of the first hinge assembly and the second hinge portion of the first hinge assembly;

an engaging portion of the first hinge portion of the first hinge assembly;

a locking member of the second hinge portion of the first hinge assembly that is movable between a locked position and an unlocked position, the locking member engaging the engaging portion of the first hinge portion when the first hinge assembly is in the locked position to secure the first hinge assembly in the locked position; and a biasing member that is sized and configured to bias the locking member into a locked position; and a second hinge assembly interconnecting the first section of the table top and the second section of the table top, the second hinge assembly being sized and configured to allow the table to be moved between the first position and the second position, the second hinge assembly including a locked position and an unlocked position, the second hinge assembly comprising:

a first hinge portion connected to the first section of the table top;

a second hinge portion connected to the second section of the table top;

a hinge pin connecting the first hinge portion of the second hinge assembly and the second hinge portion of the second hinge assembly;

an engaging portion of the first hinge portion of the second hinge assembly;

a locking member of the second hinge portion of the second hinge assembly that is movable between a locked position and an unlocked position, the locking member engaging the engaging portion of the first hinge portion when the second hinge assembly is in the locked position to secure the second hinge assembly in the locked position; and a biasing member that is sized and configured to bias the locking member into a locked position.

24. The folding table as in claim 23, further comprising a first support brace including a first end connected to the first hinge assembly and a second end connected to the first support assembly; and further comprising a second support brace including a first end connected to the second hinge assembly and a second end connected to the second support assembly.

25. The folding table as in claim 23, further comprising a first support brace connected to the first hinge assembly, the second hinge assembly and the first support assembly; and further comprising a second support brace connected to the first hinge assembly, the second hinge assembly and the second support assembly.

26. The folding table as in claim 23, further comprising a frame connected to the table top, the frame including a first pair of side rails connected to the first section of the table top and a second pair of side rails connected to the second section of the table top, the first hinge assembly connected to one of the first pair of side rails of the frame and connected to one of the second pair of side rails of the frame, the second hinge assembly connected to the other of the first pair of side rails of the frame and to the other of the second pair of side rails of the frame.

27. The folding table as in claim 23, wherein a single hinge pin connects the first hinge portion and the second hinge portion of the first hinge assembly, and connects the first hinge portion and the second hinge portion of the second hinge assembly.

28. The folding table as in claim 23, further comprising a handle connected to the locking member, the handle being sized and configured to move the locking member between the locked position and the unlocked position.

* * * * *

UNITED STATES PATENT AND TRADEMARK OFFICE

CERTIFICATE OF CORRECTION

PATENT NO. : 7,278,361 B2
APPLICATION NO. : 10/669756
DATED : October 9, 2007
INVENTOR(S) : Zhurong et al.

It is certified that error appears in the above-identified patent and that said Letters Patent is hereby corrected as shown below:

Drawings

Sheet 6, replace Fig. 9 with the figure depicted herein below, wherein the hinge axis has been labeled --203--

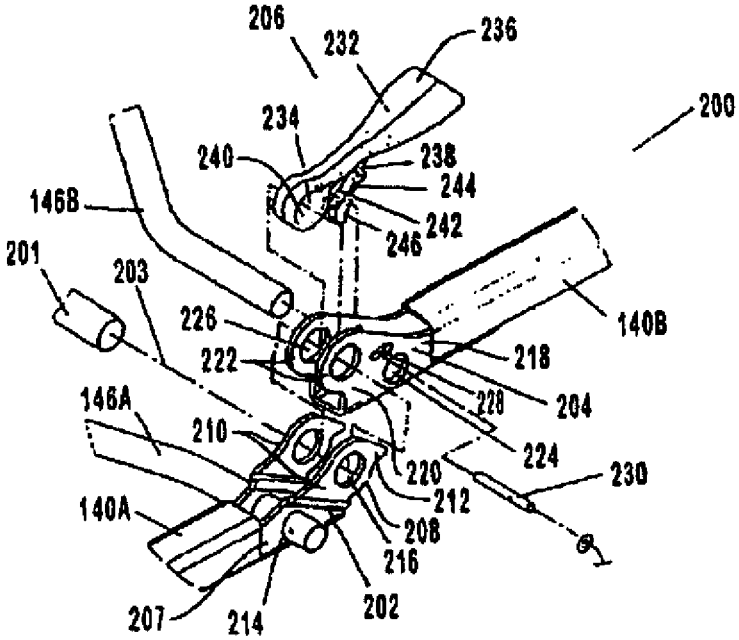

Fig. 9

UNITED STATES PATENT AND TRADEMARK OFFICE

CERTIFICATE OF CORRECTION

PATENT NO. : 7,278,361 B2 
APPLICATION NO. : 10/669756
DATED : October 9, 2007
INVENTOR(S) : Zhurong et al.

It is certified that error appears in the above-identified patent and that said Letters Patent is hereby corrected as shown below:

Drawings

Sheet 9, replace Figure 14 with the figure depicted herein below, wherein the reference for the first hinge connector has been changed from "1211" to --121--

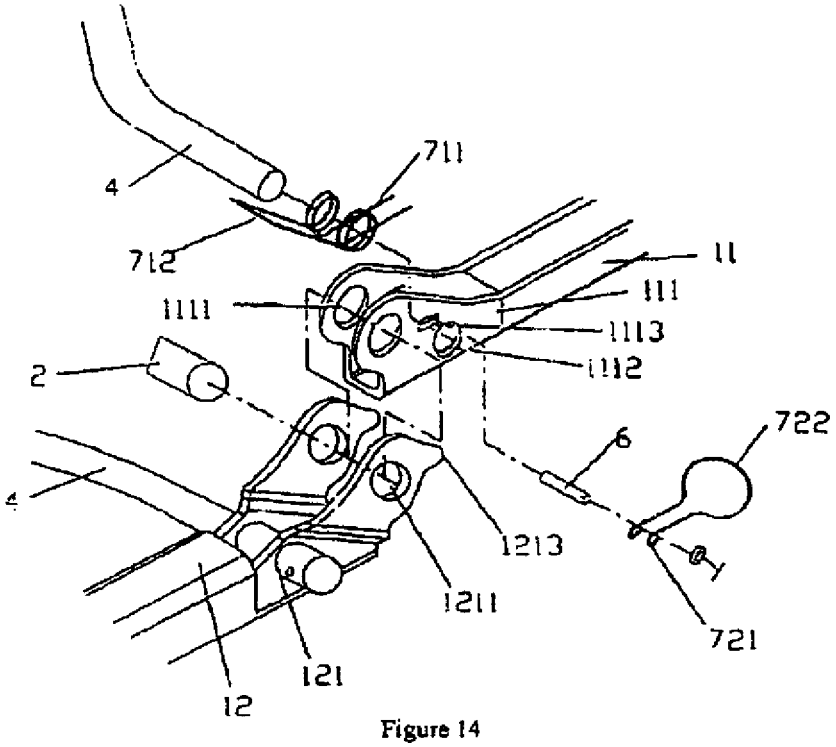

Figure 14

UNITED STATES PATENT AND TRADEMARK OFFICE

CERTIFICATE OF CORRECTION

PATENT NO. : 7,278,361 B2
APPLICATION NO. : 10/669756
DATED : October 9, 2007
INVENTOR(S) : Zhurong et al.

It is certified that error appears in the above-identified patent and that said Letters Patent is hereby corrected as shown below:

Column 8
Line 65, after "exterior end", change "152" to --154--

Column 11
Line 15, change "embodiment" to --embodiments--

Column 13
Line 26, change "When reference" to --With reference--

Column 16
Line 5, change "203" to --201--

Column 18
Line 9, after "table top", insert --; and--

Signed and Sealed this

Fifteenth Day of December, 2009

David J. Kappos

David J. Kappos
*Director of the United States Patent and Trademark Office*